US011320760B2

(12) United States Patent
Ishino et al.

(10) Patent No.: US 11,320,760 B2
(45) Date of Patent: May 3, 2022

(54) IMAGE FORMING APPARATUS AND IMAGE FORMING METHOD

(71) Applicant: KYOCERA Document Solutions Inc., Osaka (JP)

(72) Inventors: Masahito Ishino, Osaka (JP); Keiya Nishimura, Osaka (JP); Yoshitaka Imanaka, Osaka (JP); Toshiki Fujita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 159 days.

(21) Appl. No.: 16/932,191

(22) Filed: Jul. 17, 2020

(65) Prior Publication Data

US 2021/0026269 A1 Jan. 28, 2021

(30) Foreign Application Priority Data

Jul. 24, 2019 (JP) ..... JP2019-136260

(51) Int. Cl.

| | |
|---|---|
| ***G03G 15/02*** | (2006.01) |
| ***G03G 5/05*** | (2006.01) |
| ***G03G 5/06*** | (2006.01) |
| ***G03G 5/147*** | (2006.01) |

(52) U.S. Cl.

CPC ..... *G03G 15/0233* (2013.01); *G03G 5/0546* (2013.01); *G03G 5/0696* (2013.01); *G03G 5/14704* (2013.01); *G03G 5/14765* (2013.01)

(58) Field of Classification Search

CPC ..... G03G 15/0233; G03G 15/0546; G03G 15/0696; G03G 15/14704; G03G 15/14765

USPC ..... 399/130, 159, 168, 174, 176

See application file for complete search history.

(56) References Cited

U.S. PATENT DOCUMENTS 10,635,013 B2 * 4/2020 Ishino ..... G03G 5/061473
10,877,385 B1 * 12/2020 Nishimura ..... G03G 5/047

FOREIGN PATENT DOCUMENTS

JP 2007-178975 A 7/2007
JP 2009-122515 A 6/2009

* cited by examiner

*Primary Examiner* — Hoan H Tran

(74) *Attorney, Agent, or Firm* — Studebaker & Brackett PC

(57) ABSTRACT

An image forming apparatus includes an image bearing member and a charging roller that charges a circumferential surface of the image bearing member to a positive polarity. The image bearing member includes a conductive substrate and a photosensitive layer of a single layer, and satisfies formula (1) shown below. The photosensitive layer contains a charge generating material, a hole transport material, an electron transport material, and a binder resin.

$$0.60 \leqq \frac{V}{(Q/S)\times(d/\varepsilon_r\cdot\varepsilon_0)} \quad (1)$$

In formula (1), Q represents a charge amount [C] of the circumferential surface of the image bearing member, S represents a charge area [$m^2$] of the charged circumferential surface of the image bearing member, d represents a film thickness [m] of the photosensitive layer, co represents vacuum permittivity [F/m], and V represents a value calculated in accordance with formula $V=V_0-V_r$.

10 Claims, 10 Drawing Sheets

IMAGE FORMING APPARATUS AND IMAGE FORMING METHOD

INCORPORATION BY REFERENCE

The present application claims priority under 35 U.S.C. § 119 to Japanese Patent Application No. 2019-136260, filed on Jul. 24, 2019. The contents of these applications are incorporated herein by reference in their entirety.

BACKGROUND

The present disclosure relates to an image forming apparatus and an image forming method.

Electrographic image forming apparatuses use chargers for charging image bearing members. An example of such a charger is a charging roller including a conductive shaft, an elastic layer covering the conductive shaft, and a surface layer directly or indirectly covering the elastic layer. Use of the charging roller is expected to inhibit occurrence of charge irregularity. Charge irregularity is minute image irregularity (specific examples include irregularities such as spots of voids and streaks) occurring on for example a halftone image formed on a sheet. Charge irregularity is thought to occur due to non-uniform charging of the circumferential surface of an image bearing member by the charger.

SUMMARY

An image forming apparatus according to an aspect of the present disclosure includes an image bearing member and a charging roller that charges a circumferential surface of the image bearing member to a positive polarity. The image bearing member includes a conductive substrate and a photosensitive layer of a single layer, and satisfies formula (1) shown below. The photosensitive layer contains a charge generating material, a hole transport material, an electron transport material, and a first binder resin. The charging roller includes a conductive shaft, a base layer covering a surface of the conductive shaft, and a surface layer covering a surface of the base layer. The surface layer has a volume resistivity at a temperature of 32.5° C. and a relative humidity of 80% of at least 13.0 log Ω·cm.

$$0.60 \leqq \frac{V}{(Q/S)\times(d/\varepsilon_r\cdot\varepsilon_0)} \quad (1)$$

In formula (1), Q represents a charge amount [C] of the circumferential surface of the image bearing member. S represents a charge area [$m^2$] of the charged circumferential surface of the image bearing member. d represents a film thickness [m] of the photosensitive layer. $\varepsilon_r$ represents a specific permittivity of the first binder resin contained in the photosensitive layer. $\varepsilon_0$ represents vacuum permittivity [F/m]. V represents a value [V] calculated in accordance with formula $V=V_0-V_r$. $V_r$ represents a first potential [V] of the circumferential surface of the image bearing member yet to be charged by the charging roller. $V_0$ represents a second potential [V] of the circumferential surface of the image bearing member charged by the charging roller.

An image forming method according to another aspect of the present disclosure includes charging a circumferential surface of an image bearing member to a positive polarity using a charging roller. The image bearing member includes a conductive substrate and a photosensitive layer of a single layer, and satisfies formula (1) shown below. The photosensitive layer contains a charge generating material, a hole transport material, an electron transport material, and a first binder resin. The charging roller includes a conductive shaft, a base layer covering a surface of the conductive shaft, and a surface layer covering a surface of the base layer. The surface layer has a volume resistivity at a temperature of 32.5° C. and a relative humidity of 80% of at least 13.0 log Ω·cm.

$$0.60 \leqq \frac{V}{(Q/S)\times(d/\varepsilon_r\cdot\varepsilon_0)} \quad (1)$$

In formula (1), Q represents a charge amount [C] of the circumferential surface of the image bearing member. S represents a charge area [$m^2$] of the charged circumferential surface of the image bearing member. d represents a film thickness [m] of the photosensitive layer. $\varepsilon_r$ represents a specific permittivity of the first binder resin contained in the photosensitive layer. $\varepsilon_0$ represents vacuum permittivity [F/m]. V represents a value [V] calculated in accordance with formula $V=V_0-V_r$. $V_r$ represents a first potential [V] of the circumferential surface of the image bearing member yet to be charged by the charging roller. $V_0$ represents a second potential [V] of the circumferential surface of the image bearing member charged by the charging roller.

DETAILED DESCRIPTION

Figure 1:
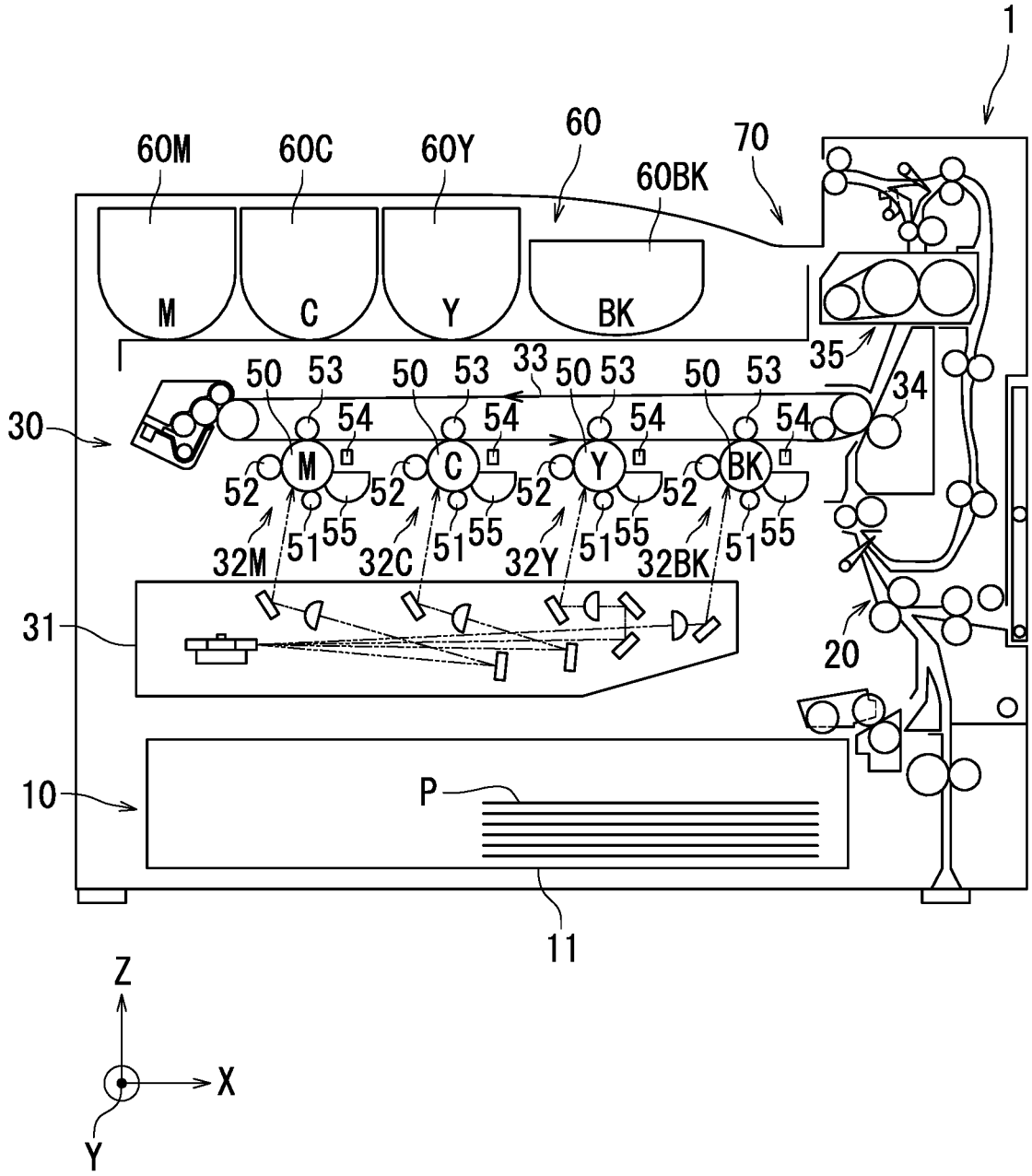
FIG. 1 is a cross-sectional view of an image forming apparatus according to a first embodiment of the present disclosure.

The following first describes terms used in the present specification. The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

Hereinafter, a halogen atom, an alkyl group having a carbon number of at least 1 and no greater than 8, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, and an alkoxy group having a carbon number of at least 1 and no greater than 4 each refer to the following, unless otherwise stated.

Examples of the halogen atom (halogen group) include a fluorine atom (fluoro group), a chlorine atom (chloro group), a bromine atom (bromo group), and an iodine atom (iodo group).

The alkyl group having a carbon number of at least 1 and no greater than 8, the alkyl group having a carbon number of at least 1 and no greater than 6, the alkyl group having a carbon number of at least 1 and no greater than 5, the alkyl group having a carbon number of at least 1 and no greater than 4, and the alkyl group having a carbon number of at least 1 and no greater than 3 each are an unsubstituted straight chain or an unsubstituted branched chain alkyl group. Examples of the alkyl group having a carbon number of at least 1 and no greater than 8 include a methyl group, an ethyl group, an n-propyl group, an isopropyl group, an n-butyl group, a sec-butyl group, a tert-butyl group, an n-pentyl group, an isopentyl group, a neopentyl group, a 1,1-dimethylpropyl group, a 1,2-dimethylpropyl group, a straight chain or branched chain hexyl group, a straight chain or branched chain heptyl group, and a straight chain or branched chain octyl group. Out of the chemical groups listed as examples of the alkyl group having a carbon number of at least 1 and no greater than 8, the chemical groups having a carbon number of at least 1 and no greater than 6 are examples of the alkyl group having a carbon number of at least 1 and no greater than 6, the chemical groups having a carbon number of at least 1 and no greater than 5 are examples of the alkyl group having a carbon number of at least 1 and no greater than 5, the chemical groups having a carbon number of at least 1 and no greater than 4 are examples of the alkyl group having a carbon number of at least 1 and no greater than 4, and the chemical groups having a carbon number of at least 1 and no greater than 3 are examples of the alkyl group having a carbon number of at least 1 and no greater than 3.

The alkoxy group having a carbon number of at least 1 and no greater than 4 is an unsubstituted straight chain or branched chain alkoxy group. Examples of the alkoxy group having a carbon number of at least 1 and no greater than 4 include a methoxy group, an ethoxy group, an n-propoxy group, an isopropoxy group, an n-butoxy group, a sec-butoxy group, and a tert-butoxy group. Through the above, terms used in the present specification have been described.

[Image Forming Apparatus]

An image forming apparatus according to a first embodiment of the present disclosure includes an image bearing member and a charging roller that charges a circumferential surface of the image bearing member to a positive polarity. The image bearing member includes a conductive substrate and a photosensitive layer of a single layer, and satisfies formula (1) shown below. The photosensitive layer contains a charge generating material, a hole transport material, an electron transport material, and a first binder resin. The charging roller includes a conductive shaft, a base layer covering a surface of the conductive shaft, and a surface layer covering a surface of the base layer. The surface layer has a volume resistivity at a temperature of 32.5° C. and a relative humidity of 80% of at least 13.0 log Ω·cm.

$$0.60 \leqq \frac{V}{(Q/S)\times(d/\varepsilon_r\cdot\varepsilon_0)} \quad (1)$$

In formula (1), Q represents a charge amount [C] of the circumferential surface of the image bearing member. S represents a charge area [$m^2$] of the charged circumferential surface of the image bearing member. d represents a film thickness [m] of the photosensitive layer. $\varepsilon_r$ represents a specific permittivity of the first binder resin contained in the photosensitive layer. $\varepsilon_0$ represents vacuum permittivity [F/m]. V represents a value [V] calculated in accordance with formula (2) $V=V_0-V_r$. $V_r$ represents a first potential [V] of the circumferential surface of the image bearing member yet to be charged by the charging roller. $V_0$ represents a second potential [V] of the circumferential surface of the image bearing member charged by the charging roller.

The following describes the image forming apparatus according to the present embodiment with reference to the accompanying drawings. Note that elements that are the same or equivalent are indicated by the same reference signs in the drawings and description thereof is not repeated. In the present embodiment, an X axis, a Y axis, and a Z axis are perpendicular to one another. The X axis and the Y axis are parallel to a horizontal plane while the Z axis is parallel to a vertical line.

The following first describes an overview of an image forming apparatus 1 according to the present embodiment with reference to FIG. 1. FIG. 1 is a cross-sectional view of the image forming apparatus 1. The image forming apparatus 1 according to the present embodiment is a full-color printer. The image forming apparatus 1 includes a feeding section 10, a conveyance section 20, an image forming section 30, a toner supply section 60, and an ejection section 70.

The feeding section 10 includes a cassette 11 that accommodates a plurality of sheets P. The feeding section 10 feeds the sheets P one at a time from the cassette 11 to the conveyance section 20. The sheets P are for example paper or are made from synthetic resin. The conveyance section 20 conveys each sheet P to the image forming section 30.

The image forming section 30 includes a light exposure device 31, a magenta-color unit (also referred to below as an M unit) 32M, a cyan-color unit (also referred to below as a C unit) 32C, a yellow-color unit (also referred to below as a Y unit) 32Y, a black-color unit (also referred to below as a BK unit) 32BK, a transfer belt 33, a secondary transfer roller 34, and a fixing device 35. The M unit 32M, the C unit 32C, the Y unit 32Y, and the BK unit each include a photosensitive member 50, a charging roller 51, a development roller 52, a primary transfer roller 53, a static elimination lamp 54, and a cleaner 55.

The light exposure device 31 irradiates each of the M unit 32M, the C unit 32C, the Y unit 32Y, and the BK unit 32BK with light based on image data to form respective electrostatic latent images on the M unit 32M, the C unit 32C, the Y unit 32Y, and the BK unit 32BK. The M unit 32M forms a toner image in a magenta color from the electrostatic latent image formed thereon. The C unit 32C forms a toner image in a cyan color from the electrostatic latent image formed thereon. The Y unit 32Y forms a toner image in a yellow color from the electrostatic latent image formed thereon. The BK unit 32BK forms a toner image in a black color from the electrostatic latent image formed thereon.

The photosensitive member 50 has a drum shape. The photosensitive member 50 rotates about a rotation center 50X (rotation axis, see FIG. 2) thereof. The charging roller 51, the development roller 52, the primary transfer roller 53, the static elimination lamp 54, and the cleaner 55 are arranged around the photosensitive member 50 in the stated order from an upstream side to a downstream side in a rotational direction R of the photosensitive member 50 (see FIG. 2). The charging roller 51 charges a circumferential surface 50*a* of the photosensitive member 50 to a positive polarity. As has been described above, the light exposure device 31 exposes the circumferential surfaces 50*a* of the respective photosensitive members 50 to light to form electrostatic latent images on the circumferential surfaces 50*a* of the photosensitive members 50. The development rollers 52 each attract a carrier CA carrying a toner T by magnetic force thereof to carry the toner T. A development bias (a development voltage) is applied to the development rollers 52 to generate a difference between a potential of each development roller 52 and a potential of the circumferential surface 50*a* of a corresponding one of the photosensitive members 50. As a result, the toner T is moved and attached to the electrostatic latent image formed on the circumferential surface 50*a* of each photosensitive member 50. In this manner, the development rollers 52 each supply the toner T to a corresponding one of the electrostatic latent images to develop the electrostatic latent image into a toner image. Through the above process, toner images are formed on the circumferential surfaces 50*a* of the respective photosensitive members 50. The toner images contain the toner T. The transfer belt 33 is in contact with the circumferential surfaces 50*a* of the photosensitive members 50. The primary transfer rollers 53 primarily transfer the respective toner images formed on the circumferential surfaces 50*a* of the photosensitive members 50 to the transfer belt (specifically, an outer surface of the transfer belt 33). Through primary transfer by the primary transfer rollers 53, the toner images in four colors are superimposed on one another on the outer surface of the transfer belt 33. The toner images in the four colors are a magenta toner image, a cyan toner image, a yellow toner image, and a black toner image. Through primary transfer as above, a color toner image is formed on the outer surface of the transfer belt 33. The secondary transfer roller 34 secondarily transfers the color toner image formed on the outer surface of the transfer belt 33 to the sheet P. The fixing device 35 fixes the color toner image to the sheet P by applying heat and pressure to the sheet P. The sheet P with the color toner image fixed thereto is ejected onto the ejection section 70. After the primary transfer, the static elimination lamps 54 included in the M unit 32M, the C unit 32C, the Y unit 32Y, and the BK unit 32BK eliminate static electricity on the circumferential surfaces 50*a* of the respective photosensitive members 50. After the primary transfer (specifically, after the primary transfer and after the static elimination), the cleaners 55 collect residual toner T remaining on the circumferential surfaces 50*a* of the respective photosensitive members 50.

The toner supply section 60 includes a toner cartridge 60M, a toner cartridge 60C, a toner cartridge 60Y, and a toner cartridge 60BK. The toner cartridge 60M contains a magenta toner T. The toner cartridge 60C contains a cyan toner T. The toner cartridge 60Y contains a yellow toner T. The toner cartridge 60BK contains a black toner T. The toner cartridge 60M, the toner cartridge 60C, the toner cartridge 60Y, and the toner cartridge 60BK respectively supply the toners T to the development rollers 52 of the M unit 32M, the C unit 32C, the Y unit 32Y, and the BK unit 32BK.

Note that the photosensitive members 50 are each equivalent to what may be referred to as an image bearing member. The development rollers 52 are each equivalent to what may be referred to as a development device. The primary transfer rollers 53 are each equivalent to what may be referred to as a transfer device. The transfer belt 33 is equivalent to what may be referred to as a transfer target. The static elimination lamps 54 are each equivalent to what may be referred to as a static eliminator. The cleaners 55 are each equivalent to what may be referred to as a cleaning device.

Figure 2:
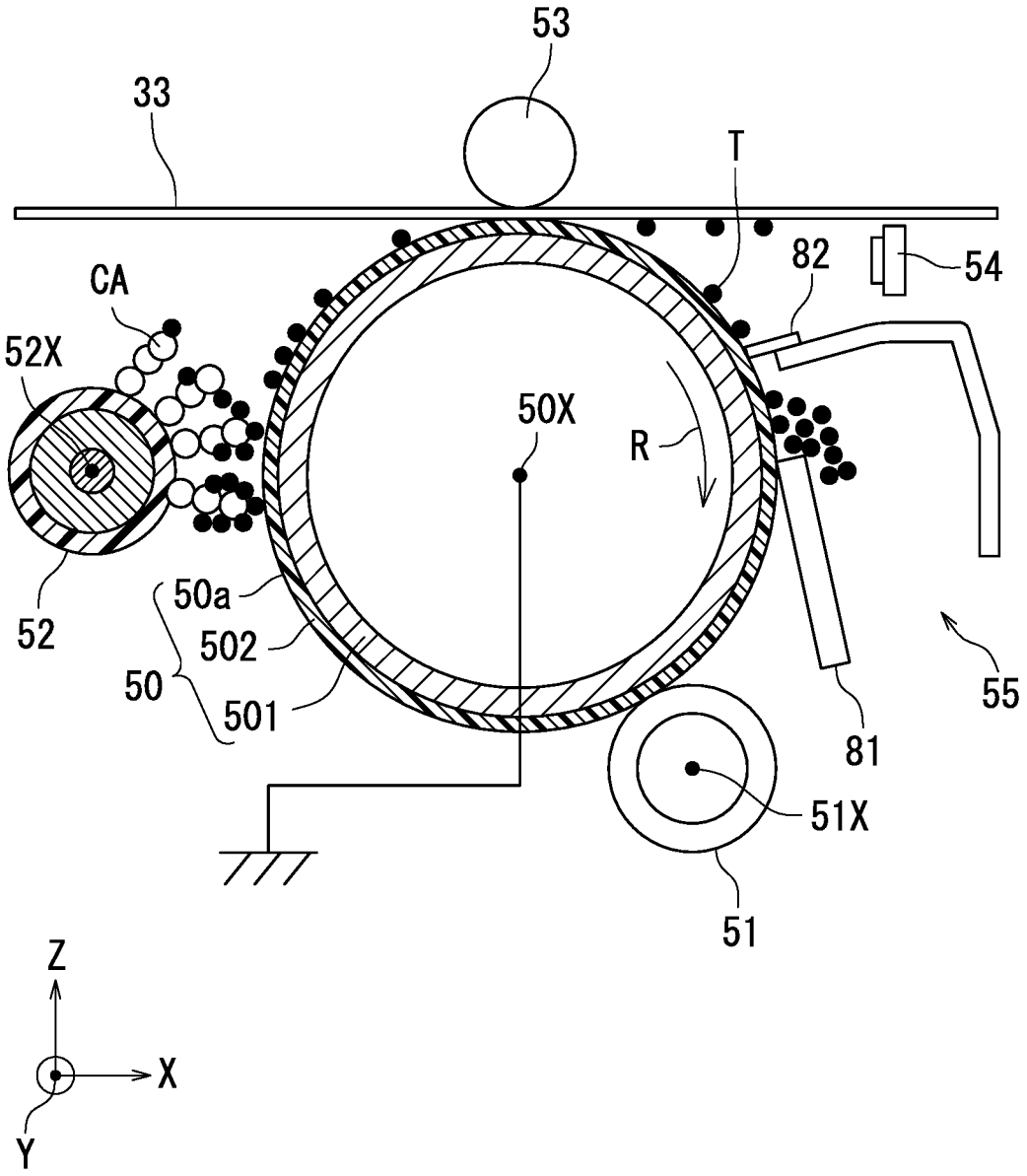
FIG. 2 is a diagram illustrating a photosensitive member and elements therearound included in the image forming apparatus illustrated in FIG. 1.
Figure 3:
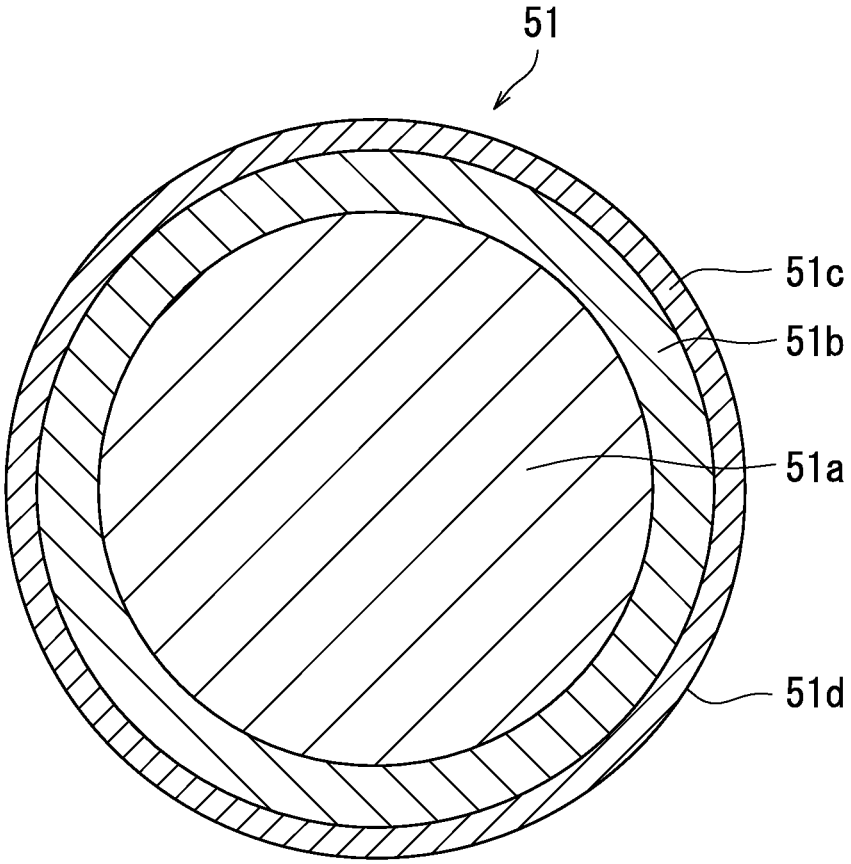
FIG. 3 is a partial cross-sectional view of an example of a charging roller included in the image forming apparatus illustrated in FIG. 1.

The following further describes the image forming apparatus 1 according to the present embodiment with reference to FIGS. 2 and 3. FIG. 2 illustrates the photosensitive member 50 and elements therearound. The image forming apparatus 1 according to the present embodiment includes charging rollers 51, cleaners 55, and photosensitive members 50 that are each equivalent to an image bearing member. The cleaners 55 each include a cleaning blade 81 equivalent to what may be referred to as a cleaning member. Each of the charging rollers 51 charges a circumferential surface 50*a* of a corresponding one of the photosensitive members 50 to a positive polarity. The cleaning blade 81 is pressed against the circumferential surface 50*a* of the photosensitive member 50 and collects residual toner T on the circumferential surface 50*a* of the photosensitive member 50.

The charging rollers 51 are further described next with reference to FIG. 3. FIG. 3 illustrates a charging roller 51. The charging roller 51 includes a conductive shaft 51*a*, a base layer 51*b* covering a surface of the conductive shaft 51*a*, and a surface layer 51*c* covering a surface of the base layer 51*b*. The surface layer 51*c* is an outermost layer of the charging roller 51.

The photosensitive members 50 satisfying formula (1) has excellent charge characteristics. As a result of the image forming apparatus 1 including the photosensitive members 50 excellent in charge characteristics, occurrence of a ghost image can be inhibited. The term ghost image refers to a phenomenon described as appearance of a residual image along with an output image (an image formed on a sheet P), which in other words is reappearance of an image formed during a previous rotation of a photosensitive member 50. A ghost image occurs due to non-uniform charging of the circumferential surface 50*a* of the photosensitive member 50. Examples of factors of non-uniform charging of the circumferential surface 50*a* of the photosensitive member 50 include variation in charge injection to the photosensitive layer 502 of the photosensitive member 50, presence of residual charge in the photosensitive layer 502, and a phenomenon in which electric current flows into the photosensitive layer 502 non-uniformly according to presence or absence of a toner image on the photosensitive layer 502 in transfer.

A ghost image is likely to occur when using the photosensitive member 50 including the photosensitive layer 502 of a single layer as compared to when using a photosensitive member including a photosensitive layer of multiple layers. This is because the photosensitive layer 502 of a single layer is relatively thick. Specifically, electrons and holes generated from a charge generating material tend to remain in the photosensitive layer 502 of a single layer. The residual charge in the photosensitive layer 502 inhibits uniform charging of the photosensitive member 50 to induce a ghost image. As such, a ghost image is more likely to occur when using the photosensitive member 50 including the photosensitive layer 502 of a single layer than when using a photosensitive member including a photosensitive layer of multiple layers.

The inventers found that through use of the photosensitive member 50 that has excellent charge characteristics and that satisfies formula (1), uniform charging of the photosensitive member 50 can be achieved and occurrence of a ghost image can be inhibited accordingly. However, the inventors discovered that charge irregularity is likely to occur in an image forming apparatus including the photosensitive member 50 excellent in charge characteristics. A cause of occurrence of charge irregularity is thought to be as follows. First, the charging roller 51 charges the circumferential surface 50*a* of the photosensitive member 50 by discharging to the photosensitive member 50 from a surface 51*d* of the charging roller 51. In discharging, electric current in a radial direction of the charging roller 51 from the conductive shaft 51*a* toward the surface 51*d* is generated in the charging roller 51. However, an area that tends to discharge more than an area therearound may be present in the surface 51*d* of the charging roller 51. When such an area that is more likely to discharge than an area therearound is present in a conventional charging roller, cross current may be generated on the surface layer 51*c* thereof and concentrated electrical discharge to the photosensitive member may occur in an area where such electrical discharge is likely to occur. When concentrated electrical discharge occurs on the surface of the conventional charging roller, part of the circumferential surface of the photosensitive member is excessively charged. As such, charge irregularity (for example, spots of voids) is thought to occur in an image forming apparatus including the conventional charging roller.

By contrast, the surface layer 51*c* of the charging roller 51 in the present embodiment has a volume resistivity at a temperature of 32.5° C. and a relative humidity of 80% of at least 13.0 log Ω·cm. That is, the surface layer 51*c* has a high surface resistance. The above configuration with the surface layer having a high surface resistance enables the charging roller 51 to discharge diffusely to the photosensitive member 50. As a result, generation of cross current as described above on the surface layer 51*c* can be inhibited. From the above, the image forming apparatus 1 is thought to be able to inhibit occurrence of charge irregularity. Note that the surface layer 51*c* of the charging roller 51 has a relatively high volume resistivity, and therefore, it is difficult for the charging roller 51 to sufficiently charge the conventional photosensitive member. However, the photosensitive member 50 of the image forming apparatus 1 satisfies formula (1) shown above and is excellent in chargeability. Therefore, the charging roller 51 can sufficiently charge the photosensitive member 50.

<Photosensitive Member>

Figure 4:
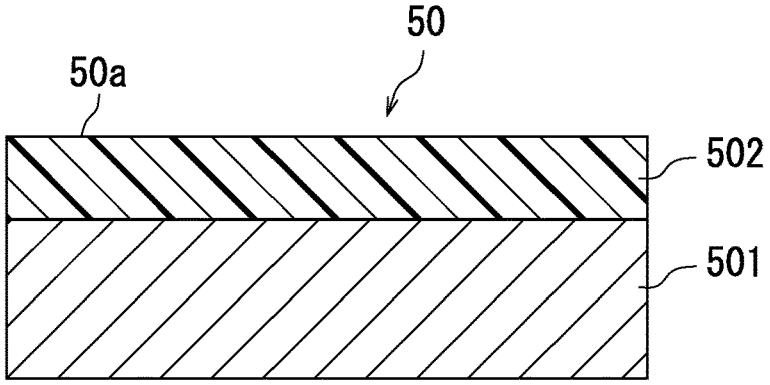
FIG. 4 is a partial cross-sectional view of an example of the photosensitive member included in the image forming apparatus illustrated in FIG. 1.
Figure 5:
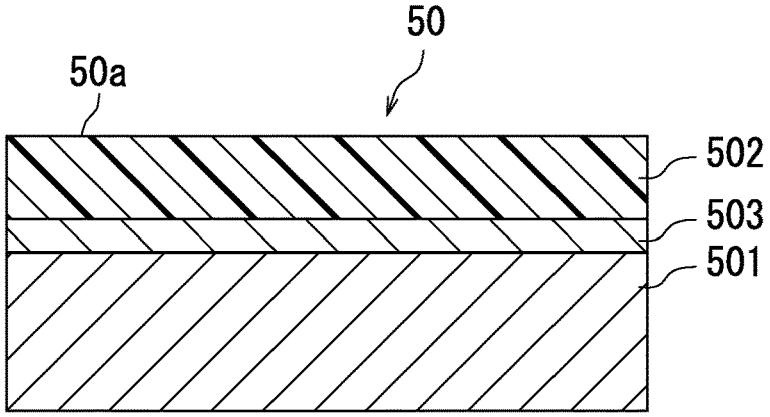
FIG. 5 is a partial cross-sectional view of an example of the photosensitive member included in the image forming apparatus illustrated in FIG. 1.
Figure 6:
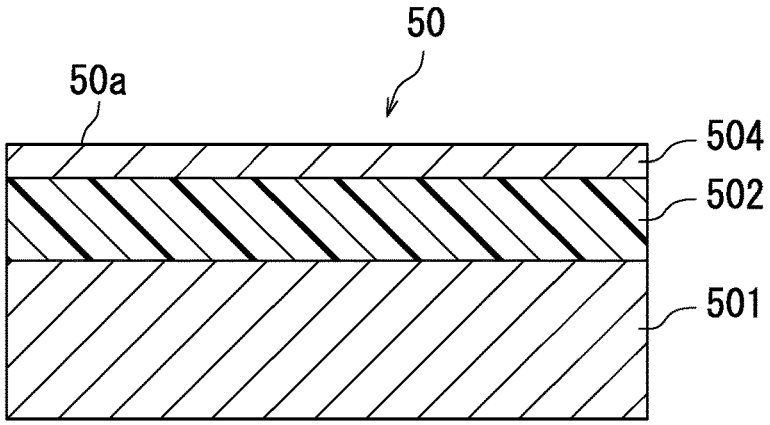
FIG. 6 is a partial cross-sectional view of an example of the photosensitive member included in the image forming apparatus illustrated in FIG. 1.

The following describes the photosensitive members 50 included in the image forming apparatus 1 with reference to FIGS. 4 to 6. FIGS. 4 to 6 are partial cross-sectional views each illustrating an example of the photosensitive members 50. Each photosensitive member 50 is for example an organic photoconductor (OPC) drum.

As illustrated in FIG. 4, the photosensitive member 50 includes for example a conductive substrate 501 and a photosensitive layer 502. The photosensitive layer 502 is a single layer (one layer). The photosensitive member 50 is a single-layer electrophotographic photosensitive member including the photosensitive layer 502 of a single layer. The photosensitive layer 502 contains a charge generating material, a hole transport material, an electron transport material, and a first binder resin. Although no particular limitations are placed on film thickness of the photosensitive layer 502, the photosensitive layer 502 has a film thickness of preferably at least 5 μm and no greater than 100 μm, more preferably at least 10 μm and no greater than 50 μm, further preferably at least 10 μm and no greater than 35 μm, and still further preferably at least 15 μm and no greater than 30 μm.

As illustrated in FIG. 5, the photosensitive member 50 may include a conductive substrate 501, a photosensitive layer 502, and an intermediate layer 503 (undercoat layer). The intermediate layer 503 is disposed between the conductive substrate 501 and the photosensitive layer 502. As illustrated in FIG. 4, the photosensitive layer 502 may be disposed directly on the conductive substrate 501. Alternatively, the photosensitive layer 502 may be disposed indirectly on the conductive substrate 501 with the intermediate layer 503 therebetween as illustrated in FIG. 5. The intermediate layer 503 may be a single-layer intermediate layer or a multi-layer intermediate layer.

The photosensitive member 50 may include a conductive substrate 501, a photosensitive layer 502, and a protective layer 504 as illustrated in FIG. 6. The protective layer 504 is disposed on the photosensitive layer 502. The protective layer 504 may be a single-layer protective layer or a multi-layer protective layer.

(Chargeability Ratio)

The photosensitive member 50 satisfies formula (1) shown above. A value represented by formula (1') in formula (1) may be also referred to below as a chargeability ratio. The chargeability ratio expressed by the following formula (1') represents a ratio of an actual chargeability (measured value) of the photosensitive member 50 to a theoretical chargeability (theoretical value) of the photosensitive member 50 when the circumferential surface 50*a* of the photosensitive member 50 is charged by the charging roller 51. The ratio of the actual chargeability of the photosensitive member 50 to the theoretical chargeability of the photosensitive member 50 will be described later in detail with reference to FIG. 8.

$$\frac{V}{(Q/S)\times(d/\varepsilon_r\cdot\varepsilon_0)} \tag{1'}$$

The photosensitive member 50 satisfying formula (1) offers the following first to third advantages. The following first describes the first advantage. As long as the photosensitive member 50 satisfies formula (1), chargeability of the photosensitive member 50 is close enough to the theoretical value thereof, and therefore, the circumferential surface 50*a* of the photosensitive member 50 can be uniformly charged. This can inhibit occurrence of a ghost image.

The following describes the second advantage. The photosensitive layer 502 of the photosensitive member 50 may abrade away in the course of repeated image formation. The photosensitive layer 502 abrades away for example due to electrical discharge from the charging roller 51 to the photosensitive member 50. As long as the photosensitive member 50 satisfies formula (1), chargeability of the photosensitive member 50 is close enough to the theoretical value thereof, and therefore, the circumferential surface 50*a* of the photosensitive member 50 can be adequately charged even if a set amount of electrical discharge from the charging roller 51 to the photosensitive member 50 is low. As long as the amount of electrical discharge is set low, an abrasion amount of the photosensitive layer 502 can be reduced. Furthermore, as a result of reduction in abrasion amount of the photosensitive layer 502, the film thickness of the photosensitive layer 502 can be set small, thereby achieving reduction in manufacturing cost.

The following describes the third advantage. As long as the photosensitive member 50 satisfies formula (1), chargeability of the photosensitive member 50 is close enough to the theoretical value thereof. Therefore, the circumferential surface 50*a* of the photosensitive member 50 can be adequately charged even if a set value of electric current flowing through the charging roller 51 is low. As long as a set value of electric current flowing through the charging roller 51 is low, a decrease in conductivity of the material of the charging roller 51 (for example, rubber) through conduction can be inhibited.

In order to inhibit occurrence of a ghost image, the chargeability ratio in formula (1) is preferably at least 0.70, more preferably at least 0.80, and further preferably at least 0.90. That the chargeability ratio is 1.00 means that a measured value of chargeability of the photosensitive member 50 is equal to the theoretical value thereof. Therefore, an upper limit of the chargeability ratio is 1.00.

A chargeability ratio measurement method will be described next. V in formula (1) is a value [V] calculated in accordance with formula (2). The following describes a method for measuring a first potential $V_r$ and a second potential $V_0$ in formula (2) with reference to FIG. 7. Note that the environment in which the first potential $V_r$ and the second potential $V_0$ in formula (2) are measured is an environment at a temperature of 23° C. and a relative humidity of 50%.

Figure 7:
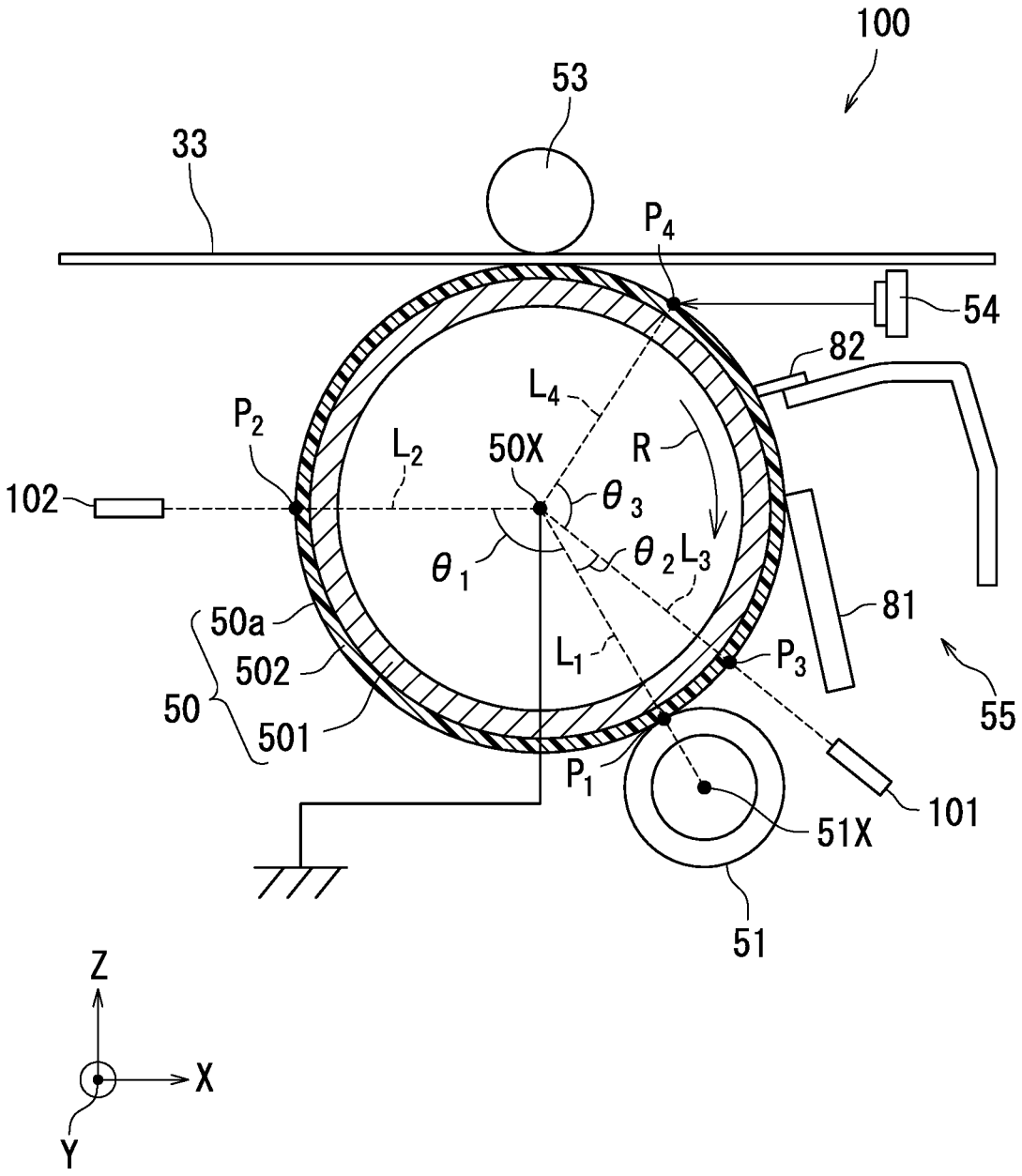
FIG. 7 is a diagram illustrating a measuring device that measures a first potential $V_r$ and a second potential $V_0$.

The first potential $V_r$ and a second potential $V_0$ can be measured using a measuring device 100 illustrated in FIG. 7. The measuring device 100 can be fabricated through first modification and second modification on the image forming apparatus 1. In the first modification, a first potential probe 101 is mounted in the image forming apparatus 1. The first potential probe 101 is arranged upstream of a charging roller 51 in a rotational direction R of a photosensitive member 50. The first potential probe 101 is connected to a first surface electrometer (not illustrated, "SURFACE ELECTROMETER MODEL344", product of TREK, INC.). In the second modification, a development roller 52 in the image forming apparatus 1 is replaced with a second potential probe 102. The second potential probe 102 is arranged at a location where a rotation center 52X (rotation axis) of the development roller 52 had been located. The second potential probe 102 is connected to a second surface electrometer (not illustrated "SURFACE ELECTROMETER MODEL344", product of TREK, INC.).

The measuring device 100 includes at least a charging roller 51, the second potential probe 102, a static elimination lamp 54, and the first potential probe 101. The photosensitive member 50 that is a measurement target is set in the measuring device 100. The charging roller 51, the second potential probe 102, the static elimination lamp 54, and the first potential probe 101 are arranged around the photosensitive member 50 in the stated order from an upstream side to a downstream side in the rotational direction R of the photosensitive member 50.

The second potential probe 102 is arranged so that an angle $\theta_1$ between a first line $L_1$ and a second line $L_2$ is 120 degrees. Here, the first line $L_1$ is a line connecting the rotation center 50X (rotation axis) of the photosensitive member 50 to a rotation center 51X (rotation axis) of the charging roller 51, and the second line $L_2$ is a line connecting the second potential probe 102 to the rotation center 50X (rotation axis) of the photosensitive member 50. An intersection point between the first line $L_1$ and the circumferential surface 50*a* of the photosensitive member 50 is a charging point $P_1$. An intersection point between the second line $L_2$ and the circumferential surface 50*a* of the photosensitive member 50 is a development point $P_2$.

The first potential probe 101 is arranged so that an angle $\theta_2$ between a third line $L_3$ and the first line $L_1$ connecting the rotation center 50X (rotation axis) of the photosensitive member 50 to the rotation center 51X (rotation axis) of the charging roller 51 is 20 degrees. Here, the third line $L_3$ is a line connecting the first potential probe 101 to the rotation center 50X (rotation axis) of the photosensitive member 50. An intersection point between the third line $L_3$ and the circumferential surface 50*a* of the photosensitive member 50 is a pre-charging point $P_3$.

A point of the circumferential surface 50*a* of the photosensitive member 50 that is irradiated with static elimination light of the static elimination lamp 54 is a static elimination point $P_4$. The static elimination lamp 54 is arranged so that an angle $\theta_3$ between a fourth line $L_4$ and the third line $L_3$ connecting the first potential probe 101 to the rotation center 50X (rotation axis) of the photosensitive member 50 is 90 degrees. Here, the fourth line $L_4$ is a line connecting the static elimination point $P_4$ to the rotation center 50X (rotation axis) of the photosensitive member 50. Note that a modified version of a multifunction peripheral ("TASKalfa (registered Japanese trademark) 356Ci", product of KYOCERA Document Solutions Inc.) can be used as the measuring device 100.

In measurement of the first potential $V_r$ and the second potential $V_0$, a charging voltage to be applied to the charging roller 51 is set to any of +1,000 V, +1,100 V, +1,200 V, +1,300 V, +1,400 V, and +1,500 V. A light quantity of the static elimination light at a time when the static elimination light emitted from the static elimination lamp 54 reaches the circumferential surface 50*a* of the photosensitive member 50 (also referred to below as a static elimination light intensity) is set to 5 $\mu J/cm^2$. The first potential $V_r$ and the second potential $V_0$ are measured while the photosensitive member 50 is rotated about the rotation center 50X (rotation axis) thereof. The charging roller 51 charges the circumferential surface 50*a* of the photosensitive member 50 to a positive polarity at the charging point $P_1$ of the photosensitive member 50. Next, the static elimination lamp 54 eliminates static electricity from the circumferential surface 50*a* of the photosensitive member 50 at the static elimination point $P_4$ of the photosensitive member 50. When the photosensitive member 50 has completed 10 rotations under the above-described charging and static elimination (also referred to below as a timing K), the first potential $V_r$ and the second potential $V_0$ are measured at the same time. Specifically, with the timing K, a potential of the circumferential surface 50*a* of the photosensitive member 50 (first potential $V_r$) is measured at the pre-charging point $P_3$ of the photosensitive member 50 using the first potential probe 101. Also, with the timing K, a potential of the circumferential surface 50*a* of the photosensitive member 50 (second potential $V_0$) is measured at the development point $P_2$ of the photosensitive member 50 using the second potential probe 102. In the manner as above, the first potentials $V_r$ and the second potentials $V_0$ under the respective conditions that the charging voltage applied to the charging roller 51 is +1,000 V, +1,100 V, +1,200 V, +1,300 V, +1,400 V, and +1,500 V are measured.

Note that in measurement of the first potential $V_r$ and the second potential $V_0$, light exposure by the light exposure device 31, development by the development roller 52, primary transfer by the primary transfer roller 53, and cleaning by the cleaning blade 81 are not performed. The cleaning blade 81 is set to have a linear pressure of 0 N/m. The method for measuring the first potential $V_r$ and the second potential $V_0$ in formula (2) has been described so far. The following describes a chargeability ratio measurement method.

The charge amount Q in formula (1) is measured under environmental conditions of a temperature of 23° C. and a relative humidity of 50%. The charge amount Q is measured according to the following method when the first potential $V_r$ and the second potential $V_0$ are measured. With the timing K when the first potential $V_r$ and the second potential $V_0$ are measured at the same time, a current value $E_1$ of electric current flowing in the charging roller 51 is measured using an ammeter voltmeter ("MINIATURE PORTABLE AMMETER AND VOLTMETER MODEL 2051", product of Yokogawa Tests & Measurement Corporation). The current values $E_1$ are measured under the respective conditions that the charging voltage applied to the charging roller 51 is +1,000 V, +1,100 V, +1,200 V, +1,300 V, +1,400 V, and +1,500 V. Charge amounts Q under the respective conditions that the charging voltage applied to the charging roller 51 is +1,000 V, +1,100 V, +1,200 V, +1,300 V, +1,400 V, and +1,500 V are calculated from the measured current values $E_1$ in accordance with the following formula (3).

$$\text{Charge amount } Q = \text{current value } E_1[A] \times \text{charging time } t[\text{second}] \quad (3)$$

Note that the charging roller 51 is connected to a high-voltage substrate (not illustrated) of the measuring device 100 through the ammeter voltmeter. Each current value $E_1$ of the electric current flowing in the charging roller 51 and the charging voltage, which has been described in association with measurement of the first potential $V_r$ and the second potential $V_0$, can be monitored using the ammeter voltmeter all the time when the measuring device 100 is activated.

In formula (1), the charge area S is an area of a charged region of the circumferential surface 50*a* of the photosensitive member 50 charged by the charging roller 51. The charge area S is calculated in accordance with the following formula (4). A charge width in formula (4) is a length of the charged region of the circumferential surface 50*a* of the photosensitive member 50 charged by the charging roller 51 in a longitudinal direction (a rotational axis direction D in FIG. 10) of the photosensitive member 50.

$$\text{Charge area } S[\text{m}^2] = \text{linear velocity [m/second] of photosensitive member 50} \times \text{charge width [m]} \times \text{charging time } t[\text{second}] \quad (4)$$

Respective values of "V" in formula (1) are calculated from the first potentials $V_r$ and the second potentials $V_0$ measured as described above. Respective values of "Q/S" in formula (1) are calculated from the charge amounts Q and the charge areas S measured as describe above. A graph is plotted with "Q/S" value on a horizontal axis and "V" value on a vertical axis. Six points are plotted in the graph representation as results of measurement under the respective conditions that the charging voltage applied to the charging roller 51 is +1,000 V, +1,100 V, +1,200 V, +1,300 V, +1,400 V, and +1,500 V. An approximate straight line of these six points is drawn. A gradient of the approximate straight line is determined from the approximate straight line. The determined gradient is taken to be "V/(Q/S)" in formula (1).

A film thickness d of the photosensitive layer 502 in formula (1) is measured under environmental conditions of a temperature of 23° C. and a relative humidity of 50%. The film thickness d of the photosensitive layer 502 is measured using a film thickness measuring device ("FISCHERSCOPE (registered Japanese trademark) MMS (registered Japanese trademark)", product of FISCHER INSTRUMENTS K.K.). Note that the film thickness of the photosensitive layer 502 is set to $30\times10^{-6}$ m in the present embodiment.

In formula (1), co represents vacuum permittivity. The vacuum permittivity co is constant and is $8.85\times10^{-12}$ [F/m].

The specific permittivity $\varepsilon_r$ of the first binder resin in formula (1) corresponds to a specific permittivity of the photosensitive layer 502 on the assumption that full amount of charge supplied from the charging roller 51 is converted to potential (surface potential) of the circumferential surface 50*a* of the photosensitive member 50 with no charge trapped within the photosensitive layer 502. The specific permittivity $\varepsilon_r$ of the first binder resin is measured using a photosensitive member for specific permittivity measurement. The photosensitive member for specific permittivity measurement includes a photosensitive layer containing only the first binder resin. The photosensitive member for specific permittivity measurement can be produced according to the same method as in the production of photosensitive members according to Examples described below in all aspects other than that any of a charge generating material, a hole transport material, an electron transport material, and an additive is not added. The specific permittivity $\varepsilon_r$ of the first binder resin is calculated using the photosensitive member for specific permittivity measurement as a measurement target in accordance with formula (5) shown below. The specific permittivity $\varepsilon_r$ of the first binder resin calculated in accordance with formula (5) is 3.5 in the present embodiment.

$$V_\varepsilon = \frac{(Q_\varepsilon / S_\varepsilon) \times d_\varepsilon}{\varepsilon_r \times \varepsilon_0} \quad (5)$$

In formula (5), $Q_\varepsilon$ represents a charge amount [C] of the photosensitive member for specific permittivity measurement. SE represents a charge area [$m^2$] of a circumferential surface 50*a* of the photosensitive member for specific permittivity measurement. $d_\varepsilon$ represents a film thickness [m] of the photosensitive layer of the photosensitive member for specific permittivity measurement. $\varepsilon_r$ represents a specific permittivity of the first binder resin. $\varepsilon_0$ represents vacuum permittivity [F/m]. $V_\varepsilon$ represents a value [V] calculated in accordance with formula $V_{0c}-V_{r\varepsilon}$. $V_{r\varepsilon}$ represents a third potential of the circumferential surface of the photosensitive member for specific permittivity measurement yet to be charged by the charging roller 51. $V_{0\varepsilon}$ represents a fourth potential of the circumferential surface of the photosensitive member for specific permittivity measurement charged by the charging roller 51.

The film thickness $d_\varepsilon$ in formula (5) is calculated according to the same method as in the calculation of the film thickness d of the photosensitive member 50 in formula (1) in all aspects other than that the photosensitive member for specific permittivity measurement is used instead of the photosensitive member 50. The film thickness $d_\varepsilon$ in formula (5) is set to $30\times10^{-6}$ m in the present embodiment. The vacuum permittivity co in formula (5) is constant and is $8.85\times10^{-12}$ F/m. The theoretical value 0 V is substituted into the third potential $V_{r\varepsilon}$ in formula (5). The charging voltage $Q_\varepsilon$ of the circumferential surface 50*a* of the photosensitive member for specific permittivity measurement is measured according to the same method as in the measurement of the charge amount Q of the circumferential surface 50*a* of the photosensitive member 50 in formula (1) in all aspects other than that the photosensitive member for specific permittivity measurement is used instead of the photosensitive member 50 and the charging voltage is set to +1,000 V. The charge area SE of the circumferential surface 50*a* of the photosensitive member for specific permittivity measurement in formula (5) is calculated according to the same method as in the calculation of the charge area S of the circumferential surface 50*a* of the photosensitive member 50 in formula (1) in all aspects other than that the photosensitive member for specific permittivity measurement is used instead of the photosensitive member 50. The fourth potential $V_{0\varepsilon}$ in formula (5) is measured according to the same method as in the measurement of the second potential $V_0$ of the photosensitive member 50 in formula (2) in all aspects other than that the photosensitive member for specific permittivity measurement is used instead of the photosensitive member 50. Using the thus obtained values, the specific permittivity $\varepsilon_r$ of the first binder resin is calculated in accordance with formula (5).

Through the above, a chargeability ratio measurement method has been described. The chargeability ratio will be further described below with reference to FIG. 8. As has been already described, the chargeability ratio indicates a ratio of an accrual chargeability (measured value) of the photosensitive member 50 to a theoretical chargeability (theoretical value) of the photosensitive member 50 when the circumferential surface 50*a* of the photosensitive member 50 is charged by the charging roller 51. The chargeability as used in the present specification indicates how much charge potential [V] of the photosensitive member 50 increases for surface charge density [C/m$^2$] of charge supplied from the charging roller 51. The theoretical chargeability (theoretical value) of the photosensitive member 50 is a value when full amount of charge supplied from the charging roller 51 to the photosensitive member 50 is converted to charge potential of the photosensitive member 50. The charge potential of the photosensitive member 50 is equivalent to a difference between the potential (first potential $V_r$) of the circumferential surface 50*a* of the photosensitive member 50 before a portion of the circumferential surface 50*a* of the photosensitive member 50 passes the charging roller 51 and the potential (second potential $V_0$) of the circumferential surface 50*a* of the photosensitive member 50 after the portion of the circumferential surface 50*a* of the photosensitive member 50 has passed the charging roller 51.

Figure 8:
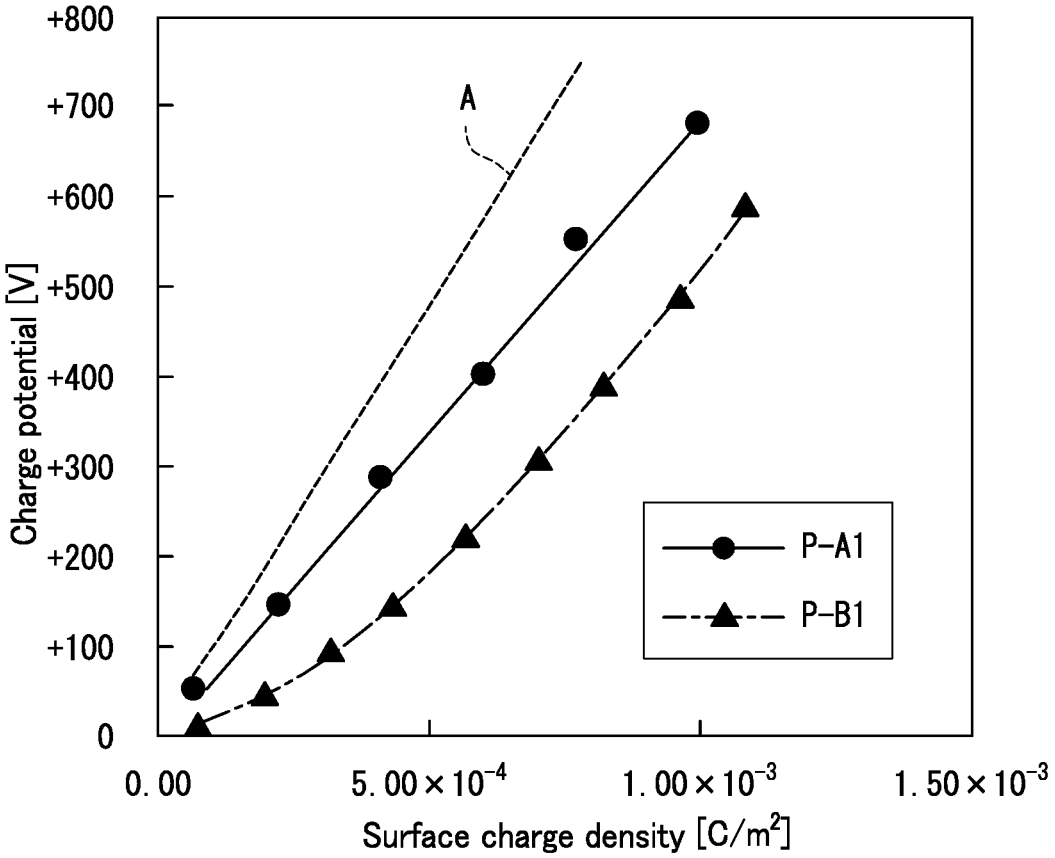
FIG. 8 is a graph representation illustrating a relationship between surface charge density and charge potential for photosensitive members.

FIG. 8 is a graph representation illustrating a relationship between surface charge density [C/m$^2$] and charge potential [V] for photosensitive members. The horizontal axis in FIG. 8 represents surface charge density. The surface charge density is a value corresponding to "Q/S" in formula (1). The vertical axis in FIG. 8 represents charge potential. The charge potential is a value corresponding to "V" in formula (1). The chargeability corresponds to the gradient "V/(Q/S)" of each graph shown in FIG. 8.

Circles on the plot in FIG. 8 each indicate a measurement result of a photosensitive member (P-A1) having a chargeability ratio of at least 0.60. Triangles on the plot in FIG. 8 each indicate a measurement result of a photosensitive member (P-B1) having a chargeability ratio of less than 0.60. Note that the photosensitive members (P-A1) and (P-B1) are produced according to a method described in association with Examples. A broken line indicated by A in FIG. 8 represents theoretical chargeability (theoretical value) of the photosensitive member 50. The theoretical chargeability (theoretical value) of the photosensitive member 50 is calculated in accordance with the following formula (6). The broken line indicated by A in FIG. 8 is obtained by plotting values corresponding to "$Q_t/S_t$" in formula (6) for the horizontal axis and plotting values corresponding to "$V_t$" in formula (6) for the vertical axis.

$$V_t = V_{0t} - V_{rt} = \frac{(Q_t/S_t)\times d_t}{\varepsilon_{rt}\times\varepsilon_o} \tag{6}$$

In formula (6), $Q_t$ represents a charge amount [C] of the circumferential surface 50*a* of the photosensitive member 50. $S_t$ represents a charge area [m$^2$] of the circumferential surface 50*a* of the photosensitive member 50. $d_t$ represents a film thickness [m] of the photosensitive layer 502 of the photosensitive member 50. $\varepsilon_{rt}$ represents a specific permittivity of the first binder resin contained in the photosensitive layer 502 of the photosensitive member 50. $\varepsilon_0$ represents vacuum permittivity [F/m]. $V_t$ represents a value [V] calculated in accordance with formula "$V_{0t}-V_{rt}$". $V_{rt}$ represents a fifth potential [V] of the circumferential surface 50*a* of the photosensitive member 50 yet to be charged by the charging roller 51. $V_{0t}$ represents a sixth potential [V] of the circumferential surface 50*a* of the photosensitive member 50 charged by the charging roller 51.

The film thickness $d_t$ in formula (6) is calculated according to the same method as in the calculation of the film thickness d of the photosensitive member 50 in formula (1). The film thickness $d_t$ in formula (6) is set to $30\times10^{-6}$ m in the present embodiment. The vacuum permittivity $\varepsilon_0$ in formula (6) is constant and is $8.85\times10^{-12}$ F/m. The theoretical value 0 V is substituted into the fifth potential $V_{rt}$ in formula (6). The charge amount $Q_t$ of the circumferential surface 50*a* of the photosensitive member 50 in formula (6) is measured according to the same method as in the measurement of the charge amount Q of the circumferential surface 50*a* of the photosensitive member 50 in formula (1). The charge area $S_t$ of the circumferential surface 50*a* of the photosensitive member 50 in formula (6) is calculated according to the same method as in the calculation of the charge area S of the circumferential surface 50*a* of the photosensitive member 50 in formula (1). The specific permittivity $\varepsilon_{rt}$ of the first binder resin in formula (6) is measured according to the same method as in the measurement of the specific permittivity $\varepsilon_r$ of the first binder resin in formula (1). The specific permittivity $\varepsilon_{rt}$ of the first binder resin in formula (6) is 3.5, the same as the specific permittivity $\varepsilon_r$ of the first binder resin in formula (1). Using the thus obtained values, the sixth potential $V_{0t}$ [V] and $V_t$ [V] are calculated in accordance with formula (6).

As illustrated in FIG. 8, the chargeability (corresponding to the gradient of the graph in FIG. 8) approximates to the broken line indicated by A as the chargeability ratio increases to be close to 1.00. When the chargeability ratio is at least 0.60, occurrence of a ghost image can be sufficiently inhibited. Through the above, the chargeability ratio of the photosensitive member 50 has been described. The following further describes the photosensitive member 50.

The circumferential surface 50*a* of the photosensitive member 50 has a surface friction coefficient of preferably at least 0.20 and no greater than 0.80, more preferably at least 0.20 and no greater than 0.60, and further preferably at least 0.20 and no greater than 0.52. As a result of the circumferential surface 50*a* of the photosensitive member 50 having a surface friction coefficient of no greater than 0.80, attachment strength of the toner T to the circumferential surface 50*a* of the photosensitive member 50 decreases, so that production of cleaning defect can be further inhibited. Also, as a result of the circumferential surface 50*a* of the photosensitive member 50 having a surface friction coefficient of no greater than 0.80, friction force of the cleaning blade 81 against the circumferential surface 50*a* of the photosensitive member 50 decreases, so that abrasion of the photosensitive layer 502 of the photosensitive member 50 can be further inhibited. Although no particular limitations are placed on a lower limit of the surface friction coefficient of the circumferential surface 50*a* of the photosensitive member 50, the surface friction coefficient can be set to for example 0.20 or more. The surface friction coefficient of the circumferential surface 50*a* of the photosensitive member 50 can be measured according to a method described in association with Examples.

In order to obtain output images having favorable image quality, the circumferential surface 50*a* of the photosensitive member 50 has a post-irradiation potential of preferably at least +50 V and no greater than +300V, and more preferably at least +80 V and no greater than +200 V. The post-irradiation potential is a potential of a region of the circumferential surface 50*a* of the photosensitive member 50 irradiated with exposure light by the light exposure device 31. The post-irradiation potential is measured after light exposure and before development. The post-irradiation potential of the photosensitive member 50 can be measured according to a method described in association with Examples.

The photosensitive layer 502 has a Martens hardness of preferably at least 150 N/mm$^2$, more preferably at least 180 N/mm$^2$, further preferably at least 200 N/mm$^2$, and further more preferably at least 220 N/mm$^2$. As a result of the photosensitive layer 502 having a Martens hardness of at least 150 N/mm$^2$, an abrasion amount of the photosensitive layer 502 decreases and abrasion resistance of the photosensitive member 50 increases. Although no particular limitations are placed on an upper limit of the Martens hardness of the photosensitive layer 502, the upper limit of the Martens hardness of the photosensitive layer 502 can be set to for example 250 N/mm$^2$. The Martens hardness of the photosensitive layer 502 can be measured according to a method described in association with Examples.

The photosensitive layer 502 contains a charge generating material, a hole transport material, an electron transport material, and a first binder resin. The photosensitive layer 502 may further contain an additive as necessary. The following describes the charge generating material, the hole transport material, the electron transport material, the first binder resin, the additive, and preferable combinations of the materials.

(Charge Generating Material)

No particular limitations are placed on the charge generating material. Examples of the charge generating material include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (for example, selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridon-based pigments. The photosensitive layer 502 may contain only one charge generating material or may contain two or more charge generating materials.

Preferable examples of a phthalocyanine-based pigment that can contribute to inhibition of occurrence of a ghost image include metal-free phthalocyanine, titanyl phthalocyanine, and chloroindium phthalocyanine. Out of the phthalocyanine-based pigments listed above, titanyl phthalocyanine is further preferable. Titanyl phthalocyanine is represented by chemical formula (CGM-1).

(CGM-1)

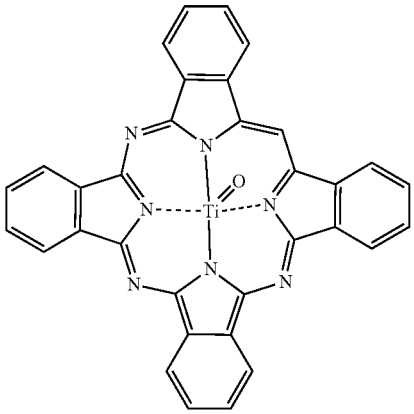

Titanyl phthalocyanine may have a crystal structure. Examples of titanyl phthalocyanine having a crystal structure include titanyl phthalocyanine having an α-form crystal structure, titanyl phthalocyanine having a β-form crystal structure, and titanyl phthalocyanine having a Y-form crystal structure (also referred to below as α-form titanyl phthalocyanine, β-form titanyl phthalocyanine, and Y-form titanyl phthalocyanine, respectively). Y-form titanyl phthalocyanine is preferable as the titanyl phthalocyanine.

Y-form titanyl phthalocyanine exhibits a main peak for example at a Bragg angle (2θ±0.2°_of 27.2° in a CuKα characteristic X-ray diffraction spectrum. The main peak in the CuKα characteristic X-ray diffraction spectrum refers to a peak having a highest or second highest intensity in a range of Bragg angles (2θ±0.2°) from 3° to 40°.

The following describes an example of a method for measuring the CuKα characteristic X-ray diffraction spectrum. A sample (titanyl phthalocyanine) is loaded into a sample holder of an X-ray diffractometer (for example, "RINT (registered Japanese trademark) 1100", product of Rigaku Corporation), and an X-ray diffraction spectrum of the sample is measured using a Cu X-ray tube, a tube voltage of 40 kV, a tube current of 30 mA, and CuKα characteristic X-rays having a wavelength of 1.542 Å. The measurement range (2θ) is for example from 3° to 40° (start angle: 3°, stop angle: 40°), and the scanning speed is for example 10°/minute.

Y-form titanyl phthalocyanine is for example classified into the following three types (A) to (C) based on thermal characteristics in differential scanning calorimetry (DSC) spectra.

(A) Y-form titanyl phthalocyanine that exhibits a peak in a range of equal to or higher than 50° C. and equal to or lower than 270° C. in a differential scanning calorimetry spectrum thereof, other than a peak resulting from vaporization of adsorbed water.

(B) Y-form titanyl phthalocyanine that does not exhibit a peak in a range of from equal to or higher than 50° C. and equal to or lower than 400° C. in a differential scanning calorimetry spectrum thereof, other than a peak resulting from vaporization of adsorbed water.

(C) Y-form titanyl phthalocyanine that does not exhibit a peak in a range of equal to or higher than 50° C. and equal to or lower than 270° C. other than a peak resulting from vaporization of adsorbed water and that exhibits a peak in a range of equal to or higher than 270° C. and equal to or lower than 400° C., in a differential scanning calorimetry spectrum thereof.

Y-form titanyl phthalocyanine is preferable that does not exhibit a peak in a range of equal to or higher than 50° C. and equal to or lower than 270° C. other than a peak resulting from vaporization of adsorbed water and that exhibits a peak in a range of equal to or higher than 270° C. and equal to or lower than 400° C., in a differential scanning calorimetry spectrum thereof. Y-form titanyl phthalocyanine that exhibits such a peak is preferably Y-form titanyl phthalocyanine that exhibits one peak in a range of equal to or higher than 270° C. and equal to or lower than 400° C., and more preferably Y-form titanyl phthalocyanine that exhibits one peak at 296° C.

The following describes an example of a differential scanning calorimetry spectrum measuring method. A sample (titanyl phthalocyanine) is placed on a sample pan, and a differential scanning calorimetry spectrum of the sample is measured using a differential scanning calorimeter (for example, "TAS-200 MODEL DSC8230D", product of Rigaku Corporation). The measurement range is for example from 40° C. to 400° C. The heating rate is for example 20° C./minute.

A content percentage of the charge generating material in the photosensitive layer 502 is preferably greater than 0.0% by mass and no greater than 1.0% by mass, and more preferably greater than 0.0% by mass and no greater than 0.5% by mass. As a result of the content percentage of the charge generating material in the photosensitive layer 502 being no greater than 1.0% by mass, the chargeability ratio can be increased. In content percentage calculation, mass of the photosensitive layer 502 is total mass of materials contained in the photosensitive layer 502. In a case where the photosensitive layer 502 contains a charge generating material, a hole transport material, an electron transport material, and a first binder resin, the mass of the photosensitive layer 502 is total mass of the charge generating material, the hole transport material, the electron transport material, and the first binder resin. In a case where the photosensitive layer 502 contains a charge generating material, a hole transport material, an electron transport material, a first binder resin, and an additive, the mass of the photosensitive layer 502 is total mass of the charge generating material, the hole transport material, the electron transport material, the first binder resin, and the additive.

(Hole Transport Material)

No particular limitations are placed on the hole transport material. Examples of the hole transport material include nitrogen-containing cyclic compounds and condensed polycyclic compounds. Examples of the nitrogen-containing cyclic compounds and condensed polycyclic compounds include triphenylamine derivatives; diamine derivatives (specific examples include an N,N,N',N'-tetraphenylbenzidine derivative, an N,N,N',N'-tetraphenylphenylenediamine derivative, an N,N,N',N'-tetraphenylnaphtylenediamine derivative, a di(amnophenylethenyl)benzene derivative, and an N,N,N',N'-tetraphenylphenanthrylenediamine derivative); oxadiazole-based compounds (specific examples include 2,5-di(4-methylaminophenyl)-1,3,4-oxadiazole); styryl-based compounds (specific examples include 9-(4-diethylaminostyryl)anthracene); carbazole-based compounds (specific examples include polyvinyl carbazole); organic polysilane compounds; pyrazoline-based compounds (specific examples include 1-phenyl-3-(p-dimethyl aminophenyl)pyrazoline); hydrazone-based compounds; indole-based compounds; oxazole-based compounds; isoxazole-based compounds; thyazike-based compounds; thiadiazole-based compounds; imidazole-based compounds; pyrazole-based compounds; and triazole-based compounds. The photosensitive layer 502 may contain only one hole transport material or may contain two or more hole transport materials.

An example of a preferable hole transport material that can contribute to inhibition of occurrence of a ghost image is a compound represented by general formula (10) shown below (also referred to below as a hole transport material (10)).

(10)

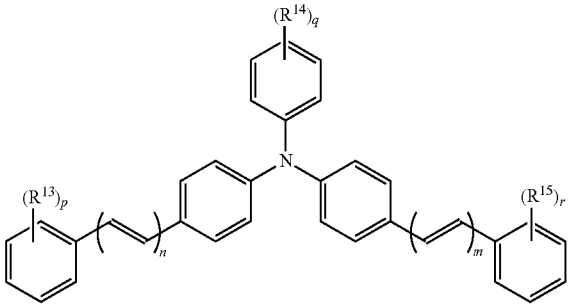

In general formula (10), $R^{13}$ to $R^{15}$ each represent, independently of one another, an alkyl group having a carbon number of at least 1 and no greater than 4 or an alkoxy group having a carbon number of at least 1 and no greater than 4. m and n each represent, independently of one another, an integer of at least 1 and no greater than 3. p and r each represent, independently of one another, 0 or 1. q represents an integer of at least 0 and no greater than 2. When q represents 2, two chemical groups $R^{14}$ may be the same as or different from one another.

In general formula (10), $R^{14}$ is preferably an alkyl group having a carbon number of at least 1 and no greater than 4, more preferably a methyl group, an ethyl group, or an n-butyl group, and particularly preferably an n-butyl group. Preferably, q is 1 or 2. More preferably, q is 1. Preferably, p and r each are 0. Preferably, m and n each are 1 or 2. More preferably, m and n each are 2.

A preferable example of the hole transport material (10) is a compound represented by chemical formula (HTM-1) shown below (also referred to below as a hole transport material (HTM-1)).

(HTM-1)

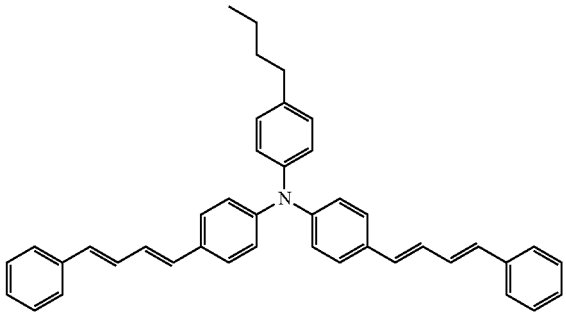

A content percentage of the hole transport material in the photosensitive layer 502 is preferably greater than 0.0% by mass and no greater than 35.0% by mass, and more preferably at least 10.0% by mass and no greater than 30.0% by mass.

(First Binder Resin)

Examples of the first binder resin include thermoplastic resins, thermosetting resins, and photocurable resins. Examples of the thermoplastic resins include polycarbonate resins, polyarylate resins, styrene-butadiene copolymers, styrene-acrylonitrile copolymers, styrene-maleic acid copolymers, acrylic acid polymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of the thermosetting resins include silicone resins, epoxy resins, phenolic resins, urea resins, and melamine resins. Examples of the photocurable resins include acrylic acid adducts of epoxy compounds and acrylic acid adducts of urethane compounds. The photosensitive layer 502 may contain only one first binder resin or may contain two or more first binder resins.

In order to inhibit occurrence of a ghost image, the first binder resin preferably includes a polyarylate resin (also referred to below as a polyarylate resin (20)) including a repeating unit represented by general formula (20) shown below (also referred to below as a repeating unit (20)).

(20)

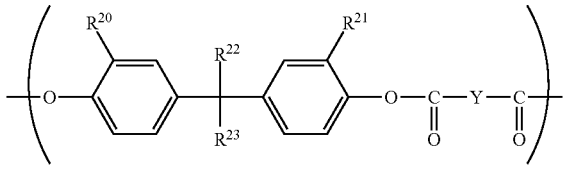

In general formula (20), $R^{20}$ and $R^{21}$ each represent, independently of one another, a hydrogen atom or an alkyl group having a carbon number of at least 1 and no greater than 4. $R^{22}$ and $R^{23}$ each represent, independently of one another, a hydrogen atom, a phenyl group, or an alkyl group having a carbon number of at least 1 and no greater than 4. $R^{22}$ and $R^{23}$ may be bonded to one another to form a divalent group represented by general formula (W) shown below. Y represents a divalent group represented by chemical formula (Y1), (Y2), (Y3), (Y4), (Y5), or (Y6) shown below.

(W)

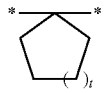

In general formula (W), t represents an integer of at least 1 and no greater than 3. * represents a bond.

(Y1)

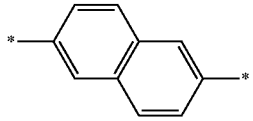

(Y2)

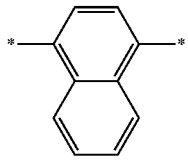

(Y3)

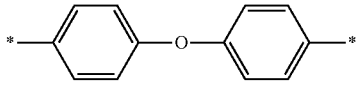

(Y4)

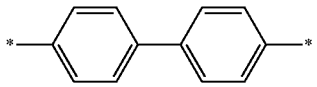

(Y5)

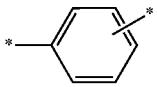

(Y6)

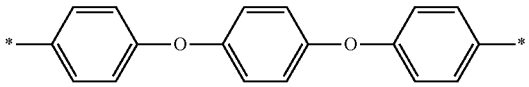

In chemical formulas (Y1) to (Y6), * represents a bond. Specifically, * in chemical formulas (Y1) to (Y6) represents a bond to a carbon atom to which Y in general formula (20) is bonded.

In general formula (20), $R^{20}$ and $R^{21}$ each are preferably an alkyl group having a carbon number of at least 1 and no greater than 4, and more preferably a methyl group. $R^{22}$ and $R^{23}$ are preferably bonded to one another to form a divalent group represented by general formula (W). Preferably, Y is a divalent group represented by chemical formula (Y1) or (Y3). Preferably, tin general formula (W) is 2.

The polyarylate resin (20) preferably includes only the repeating unit represented by general formula (20), but may additionally include another repeating unit. A ratio (mole fraction) of the number of the repeating units (20) to a total number of repeating units in the polyarylate resin (20) is preferably at least 0.80, more preferably, at least 0.90, and further preferably 1.00. The polyarylate resin (20) may include only one type of the repeating unit (20) or may include two or more types (for example, two types) of the repeating unit (20).

Note that in the present specification, the ratio (mole fraction) of the number of the repeating units (20) to the total number of repeating units in the polyarylate resin (20) is a number average value obtained from the entirety (a plurality of resin chains) of the polyarylate resin (20) contained in the photosensitive layer 502, rather than a value obtained from one resin chain thereof. The mole fraction can be calculated for example from a $^{1}$H-NMR spectrum of the polyarylate resin (20) plotted using a proton nuclear magnetic resonance spectrometer.

Preferable examples of the repeating unit (20) include a repeating unit represented by chemical formula (20-a) shown below and a repeating unit represented by chemical formula (20-b) shown below (also referred to below as repeating units (20-a) and (20-b), respectively). The polyarylate resin (20) preferably includes at least one of the repeating units (20-a) and (20-b), and more preferably includes both of the repeating units (20-a) and (20-b).

(20-a)

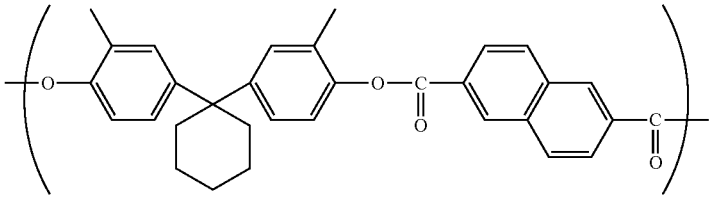

(20-b)

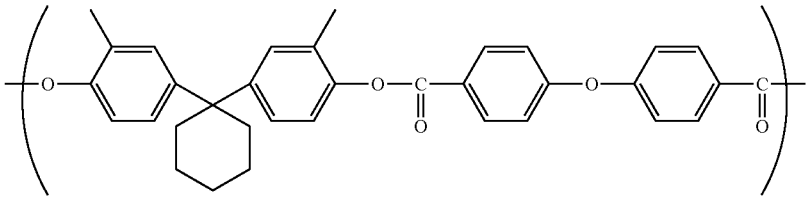

In a case where the polyarylate resin (20) includes both of the repeating units (20-a) and (20-b), no particular limitations are placed on the sequence of the repeating units (20-a) and (20-b). The polyarylate resin (20) including the repeating units (20-a) and (20-b) may be a random copolymer, a block copolymer, a periodic copolymer, or an alternating copolymer.

In a case where the polyarylate resin (20) includes both of the repeating units (20-a) and (20-b), a preferable example of the polyarylate resin (20) is a polyarylate resin having a main chain represented by general formula (20-1) shown below.

(20-1)

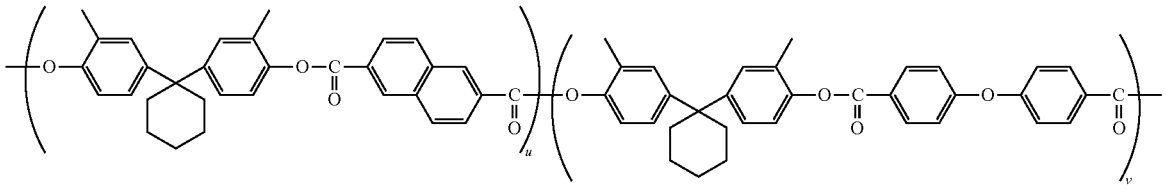

In general formula (20-1), u and v each represent, independently of one another, a number of at least 30 and no greater than 70. A sum of u and v is 100.

Independently of one another, u and v each are preferably a number of at least 40 and no greater than 60, more preferably, a number of at least 45 and no greater than 55, still more preferably a number of at least 49 and no greater than 51, and particularly preferably 50. Note that u represents a percentage of the number of the repeating units (20-a) to a sum of the number of the repeating units (20-a) and the number of the repeating units (20-b) included in the polyarylate resin (20). Also, v represents a percentage of the number of the repeating units (20-b) to the sum of the number of the repeating units (20-a) and the number of the repeating units (20-b) included in the polyarylate resin (20). A preferable example of a polyarylate resin having the main chain represented by general formula (20-1) is a polyarylate resin having a main chain represented by general formula (20-1a) shown below.

(20-1a)

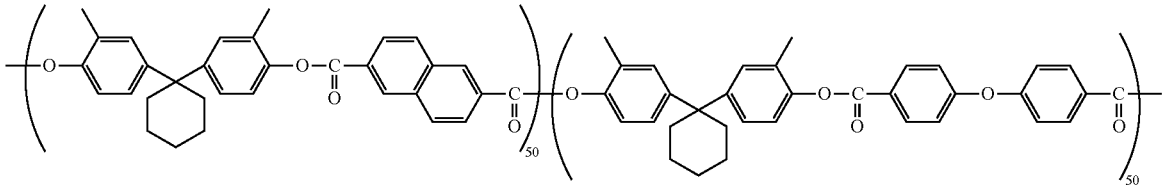

The polyarylate resin (20) may have a terminal group represented by chemical formula (Z) shown below. In chemical formula (Z), * represents a bond. Specifically, * in chemical formula (Z) represents a bond to a main chain of the polyarylate resin (20). In a case where the polyarylate resin (20) includes the repeating unit (20-a), the repeating unit (20-b), and a terminal group represented by chemical formula (Z), the terminal group may be bonded to the repeating unit (20-a) or the repeating unit (20-b).

(Z)

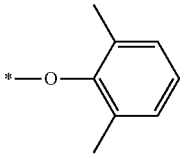

In order to inhibit occurrence of a ghost image, the polyarylate resin (20) preferably includes a polyarylate resin having a main chain represented by general formula (20-1) and a terminal group represented by chemical formula (Z). More preferably, the polyarylate resin (20) includes a main chain represented by general formula (20-1a) and having a terminal group represented by chemical formula (Z). In the following description, the polyarylate resin including a main chain represented by general formula (20-1a) and having a terminal group represented by chemical formula (Z) may be referred to as a polyarylate resin (R-1).

The first binder resin has a viscosity average molecular weight of preferably at least 10,000, more preferably at least 20,000, further preferably at least 30,000, further more preferably at least 50,000, and particularly preferably at least 55,000. As a result of the first binder resin having a viscosity average molecular weight of at least 10,000, abrasion resistance of the photosensitive member 50 tends to increase. By contrast, the first binder resin has a viscosity average molecular weight of preferably no greater than 80,000, and more preferably no greater than 70,000. As a result of the first binder resin having a viscosity average molecular weight of no greater than 80,000, the first binder resin readily dissolves in a solvent for photosensitive layer formation, thereby showing a tendency to facilitate formation of the photosensitive layer 502.

A content percentage of the first binder resin in the photosensitive layer 502 is preferably at least 30.0% by mass and no greater than 70.0% by mass, and more preferably at least 40.0% by mass and no greater than 60.0% by mass.

(Electron Transport Material)

Examples of the electron transport material include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of the quinone-based compounds include diphenoquinone-based compounds, azoquinone-based compounds, anthraquinone-based compounds, naphthoquinone-based compounds, nitroanthraquinone-based compounds, and dinitroanthraquinone-based compounds. The photosensitive layer 502 may contain only one electron transport material or may contain two or more electron transport materials.

Preferable examples of an electron transport materials that can contribute to inhibition of occurrence of a ghost image include compounds represented by general formulas (31), (32), and (33) shown below (also referred to below as electron transport materials (31), (32), and (33), respectively).

(31)

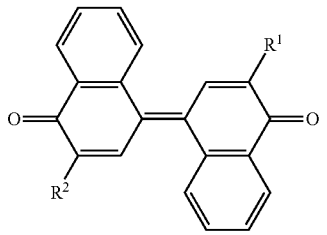

(32)

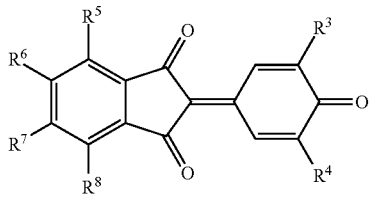

(33)

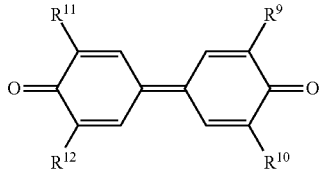

In general formulas (31) to (33), $R^1$ to $R^4$ and $R^9$ to $R'^2$ each represent, independently of one another, an alkyl group having a carbon number of at least 1 and no greater than 8. $R^5$ to $R^8$ each represent, independently of one another, a hydrogen atom, a halogen atom, or an alkyl group having a carbon number of at least 1 and no greater than 4.

In general formulas (31) to (33), an alkyl group having a carbon number of at least 1 and no greater than 8 that may be represented by any of $R^1$ to $R^4$ and $R^9$ to $R'^2$ is preferably an alkyl group having a carbon number of at least 1 and no greater than 5, and more preferably a methyl group, a tert-butyl group, or a 1,1-dimethylpropyl group. Preferably, $R^5$ to $R^8$ each are a hydrogen atom.

The electron transport material (31) is preferably a compound represented by chemical formula (ETM-1) shown below (also referred to below as an electron transport material (ETM-1)). The electron transport material (32) is preferably a compound represented by chemical formula (ETM-3) shown below (also referred to below as an electron transport material (ETM-3)). The electron transport material (33) is preferably a compound represented by chemical formula (ETM-2) shown below (also referred to below as an electron transport material (ETM-2)).

(ETM-1)

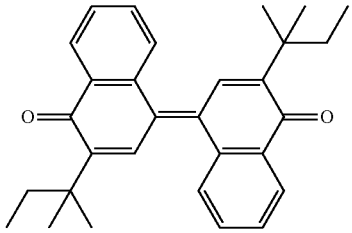

(ETM-2)

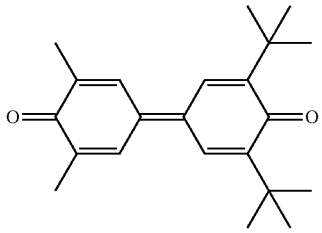

(ETM-3)

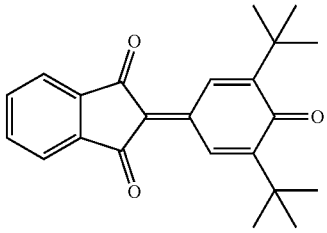

In order to inhibit occurrence of a ghost image, the photosensitive layer 502 preferably contains at least one of the electron transport material (31) and the electron transport material (32) as the electron transport material, and more preferably contains both (two) the electron transport material (31) and the electron transport material (32).

In order to inhibit occurrence of a ghost image, the photosensitive layer 502 preferably contains at least one of the electron transport material (ETM-1) and the electron transport material (ETM-3) as the electron transport material, and more preferably contains both (two) the electron transport material (ETM-1) and the electron transport material (ETM-3).

A content percentage of the electron transport material in the photosensitive layer 502 is preferably at least 5.0% by mass and no greater than 50.0% by mass, and more preferably at least 20.0% by mass and no greater than 30.0% by mass. In a case of the photosensitive layer 502 containing two or more electron transport materials, the content percentage of the electron transport material refers to a total content percentage of the two or more electron transport materials.

(Additive)

The photosensitive layer 502 may further contain a specific compound represented by general formula (40) shown below (also referred to below as an additive (40)) as necessary. However, in order to increase the chargeability ratio, it is preferable that the photosensitive layer 502 does not contain the additive (40). In a situation in which the additive (40) is used according to necessity, a content percentage of the additive (40) in the photosensitive layer 502 is set to greater than 0.0% by mass and no greater than 1.0% by mass. The additive (40) can be used for example to adjust the chargeability ratio.

$$R^{40}\text{-A-}R^{41} \quad (40)$$

In general formula (40), $R^{40}$ and $R^{41}$ each represent, independently of one another, a hydrogen atom or a monovalent group represented by general formula (40a) shown below.

(40a)

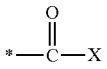

In general formula (40a), X represents a halogen atom. Examples of the halogen atom represented by X include a fluorine atom, a chlorine atom, a bromine atom, and an iodine atom. Preferably, the halogen atom represented by X is a chlorine atom. * represents a bond. Specifically, * in general formula (40a) represents a bond to a carbon atom to which $R^{40}$ or $R^{41}$ in general formula (40a) is bonded.

In general formula (40), A represents a divalent group represented by chemical formula (A1), (A2), (A3), (A4), (A5), or (A6) shown below. In chemical formulas (A1) to (A6), * represents a bond. Specifically, * in chemical formulas (A1), (A2), (A3), (A4), (A5), and (A6) represents a bond to a carbon atom to which A in general formula (40) is bonded. Preferably, the divalent group represented by A is a divalent group represented by chemical formula (A4).

(A1)

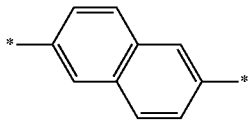

-continued (A2)

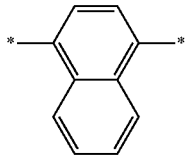

(A3)

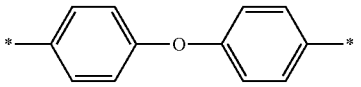

(A4)

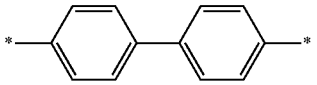

(A5)

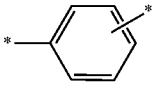

(A6)

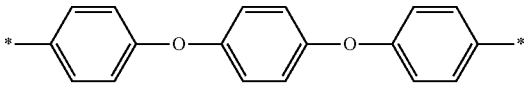

A specific example of the additive (40) is a compound represented by chemical formula (40-1) shown below (also referred to below as an additive (40-1)).

(40-1)

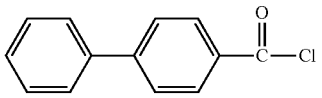

The photosensitive layer 502 may further contain an additive other than the additive (40) (also referred to below as an additional additive) as necessary. Examples of the additional additive include antidegradants (specific examples include antioxidants, radical scavengers, quenchers, and ultraviolet absorbing agents), softeners, surface modifiers, extenders, thickeners, dispersion stabilizers, waxes, donors, surfactants, and leveling agents. In a case where the additional additive is contained in the photosensitive layer 502, the photosensitive layer 502 may contain only one additional additive or may contain two or more additional additives.

(Combination of Materials)

In order to inhibit occurrence of a ghost image, the photosensitive layer 502 preferably contains: materials of types and content percentages indicated in Combination example Nos. 1 to 3 in Table 1 below; materials of types and content percentages indicated in Combination example Nos. 4 to 6 in Table 2 below; or materials of types and content percentages indicated in Combination example Nos. 7 to 9 in Table 3 below.

TABLE 1

| Combination | CGM | ETM | Additive | |
|---|---|---|---|---|
| example | Content percentage | Type | Type | Content percentage |
| No. 1 | 0.5 wt % < CGM ≤ 1.0 wt % | ETM-1/ETM-3 | 40-1 | 0.0 wt % < additive ≤ 1.0 wt % |
| No. 2 | 0.5 wt % < CGM ≤ 1.0 wt % | ETM-1/ETM-3 | — | — |
| No. 3 | 0.0 wt % < CGM ≤ 0.5 wt % | ETM-1/ETM-3 | — | — |

TABLE 2

| Combination | CGM | HTM | ETM | Additive | |
|---|---|---|---|---|---|
| example | Content percentage | Type | Type | Type | Content percentage |
| No. 4 | 0.5 wt % < CGM ≤ 1.0 wt % | HTM-1 | ETM-1/ETM-3 | 40-1 | 0.0 wt % < additive ≤ 1.0 wt % |
| No. 5 | 0.5 wt % < CGM ≤ 1.0 wt % | HTM-1 | ETM-1/ETM-3 | — | — |
| No. 6 | 0.0 wt % < CGM ≤ 0.5 wt % | HTM-1 | ETM-1/ETM-3 | — | — |

TABLE 3

| Combination | CGM | | HTM | ETM | Resin | Additive | |
|---|---|---|---|---|---|---|---|
| example | Type | Content percentage | Type | Type | Type | Type | Content percentage |
| No. 7 | CGM-1 | 0.5 wt % < CGM ≤ 1.0 wt % | HTM-1 | ETM-1/ETM-3 | R-1 | 40-1 | 0.0% < additive ≤ 1.0% |
| No. 8 | CGM-1 | 0.5 wt % < CGM ≤ 1.0 wt % | HTM-1 | ETM-1/ETM-3 | R-1 | — | — |
| No. 9 | CGM-1 | 0.0 wt % < CGM ≤ 0.5 wt % | HTM-1 | ETM-1/ETM-3 | R-1 | — | — |

In Tables 1 to 3, "wt %", "CGM", "HTM", "ETM", and "Resin" respectively represent "% by mass", "charge generating material", "hole transport material", "electron transport material", and "first binder resin". In Tables 1 to 3, "Content percentage" represents a content percentage of a corresponding material in the photosensitive layer 502. In Tables 1 to 3, "ETM-1/ETM-3" indicates that both the electron transport material (ETM-1) and the electron transport material (ETM-3) are contained as the electron transport material. In Tables 1 to 3, a sign "-" indicates that no corresponding material is contained. In Table 3, "CGM-1" indicates Y-form titanyl phthalocyanine represented by chemical formula (CGM-1). The Y-form titanyl phthalocyanine in Table 3 is preferably Y-form titanyl phthalocyanine that exhibits no peak in a range of 50° C. or higher and 270° C. or lower other than a peak resulting from vaporization of adsorbed water and that exhibits a peak in a range of 270° C. or higher and 400° C. or lower (specifically, one peak at 296° C.), in a differential scanning calorimetry spectrum thereof.

(Intermediate Layer)

The intermediate layer 503 contains for example inorganic particles and a resin used for the intermediate layer 503 (intermediate layer resin). Provision of the intermediate layer 503 can facilitate flow of electric current generated when the photosensitive member 50 is exposed to light and inhibit increasing resistance, while also maintaining insulation to a sufficient degree so as to inhibit occurrence of leakage current.

Examples of the inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). One type of the inorganic particles listed above may be used independently. Alternatively, two or more types of the inorganic particles listed above may be used in combination. Note that the inorganic particles may be surface-treated. No particular limitations are placed on the intermediate layer resin as long as it can be used for formation of the intermediate layer 503.

(Photosensitive Member Production Method)

In an example of a method for producing the photosensitive member 50, an application liquid for forming the photosensitive layer 502 (also referred to below as an application liquid for photosensitive layer formation) is applied onto the conductive substrate 501. The photosensitive layer 502 is formed through the above application to produce the photosensitive member 50. The application liquid for photosensitive layer formation is prepared by dissolving or dispersing a charge generating material, a hole transport material, an electron transport material, a first binder resin, and an optional component as necessary in a solvent.

No particular limitations are placed on the solvent contained in the application liquid for photosensitive layer formation so long as each component contained in the application liquid can be dissolved or dispersed therein. Examples of the solvent include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Only one of the solvents listed above may be used independently, or two or more of the solvents listed above may be used in combination. In order to increase workability in production of the photosensitive member 50, a non-halogen solvent (a solvent other than a halogenated hydrocarbon) is preferably used as the solvent.

The application liquid for photosensitive layer formation is prepared by mixing each component to disperse the components in the solvent. Mixing or dispersion can be done by using for example a bead mill, a roll mill, a ball mill, an attritor, a paint shaker, or an ultrasonic disperser.

In order to increase dispersibility of each component, the application liquid for photosensitive layer formation may contain a surfactant, for example.

No particular limitations are placed on a method for applying the application liquid for photosensitive layer formation as long as the method enables uniform application of the application liquid onto the conductive substrate 501. Examples of the application method include blade coating, dip coating, spray coating, spin coating, and bar coating.

No particular limitations are placed on a method for drying the application liquid for photosensitive layer formation as long as the solvent in the application liquid can be evaporated through the method. Examples of the method for drying the application liquid for photosensitive layer formation include heat treatment (hot-air drying) using a high-temperature dryer or a reduced pressure dryer. The heat treatment may be performed for example at a temperature of 40° C. or higher and 150° C. or lower. The heat treatment may be performed for example for 3 minutes or longer and 120 minutes or shorter.

Note that the method for producing the photosensitive member 50 may further involve either or both formation of the intermediate layer 503 and formation of the protective layer 504 as necessary. Respective known methods are appropriately selected for the formation of the intermediate layer 503 and the formation of the protective layer 504.

Through the above, the photosensitive member 50 has been described. Referring again to FIG. 2, description will be made next about the toners T for the image forming apparatus 1, and the charging rollers 51, the primary transfer rollers 53, the static elimination lamps 54, and the cleaners 55 each included in the image forming apparatus 1.

<Toner>

The following describes the toners T that are contained in the toner cartridges 60M to 60BK illustrated in FIG. 1 and that are supplied to the circumferential surfaces 50*a* of the respective photosensitive members 50. Each of the toners T includes toner particles. The toner T is a collection (powder) of the toner particles. The toner particles each include a toner mother particle and an external additive. The toner mother particle contains at least one of a binder resin, a releasing agent, a colorant, a charge control agent, and a magnetic powder. The external additive is attached to a surface of the toner mother particle. Note that the external additive may not be contained if unnecessary. In a case where no external additive is contained, the toner mother particle corresponds to a toner particle. The toner T may be a capsule toner or a non-capsule toner. A toner T that is a capsule toner can be produced by forming shell layers on the surfaces of the toner mother particles.

The toner T preferably has a number average circularity of at least 0.960 and no greater than 0.998. As a result of the toner T having a number average circularity of at least 0.960, development and transfer can be done favorably, resulting in output of a closer image. As a result of the toner T having a number average circularity of no greater than 0.998, it is difficult for the toner T to pass through a gap between the cleaning blade 81 and the circumferential surface 50*a* of the photosensitive member 50. The number average circularity of the toner T is preferably at least 0.960 and no greater than 0.980, more preferably at least 0.965 and no greater than 0.980, further preferably at least 0.970 and no greater than 0.980, and particularly preferably at least 0.975 and no greater than 0.980. The number average circularity of the toner T can be measured using a flow particle imaging analyzer (for example, "FPIA (registered Japanese trademark) 3000", product of SYSMEX CORPORATION).

The toner T preferably has a volume median diameter (also referred to below as $D_{50}$) of at least 4.0 μm and no greater than 7.0 μm. As a result of the toner T having a $D_{50}$ of no greater than 7.0 μm, a high-definition image with no granular appearance can be output. The smaller the $D_{50}$ of the toner T is, the smaller the amount of the toner T necessary for formation of an image with a desired image density is. As such, when the toner T has a $D_{50}$ of no greater than 7.0 μm, an amount of the toner T used can be reduced. As a result of the toner T having a $D_{50}$ of at least 4.0 μm, it is difficult for the toner T to pass through a gap between the cleaning blade 81 and the circumferential surface 50*a* of the photosensitive member 50. The $D_{50}$ of the toner T is preferably at least 4.0 μm and no greater than 6.0 μm, and more preferably at least 4.0 μm and no greater than 5.0 μm. The $D_{50}$ of the toner T can be measured using a particle size distribution analyzer (for example, "COULTER COUNTER MULTISIZER 3", product of Beckman Coulter, Inc.). Note that the $D_{50}$ of the toner T is a value of particle diameter at 50% of cumulative distribution of a volume distribution of the toner T measured using a particle size distribution analyzer.

<Charging Roller>

Each of the charging rollers 51 is located in contact with or adjacent to the circumferential surface 50*a* of a corresponding one of the photosensitive members 50. The image forming apparatus 1 adopts a direct discharge process or a proximity discharge process. The charging time is shorter and the charge amount to the photosensitive member 50 is smaller in a configuration including the charging roller 51 located in contact with or adjacent to the circumferential surface 50*a* of the photosensitive member 50 than in a configuration including a scorotron charger. In image formation using the image forming apparatus 1 including the charging roller 51 located in contact with or adjacent to the circumferential surface 50*a* of the photosensitive member 50, it is difficult to uniformly charge the circumferential surface 50*a* of the photosensitive member 50 and a ghost image is likely to occur. However, as already described, the image forming apparatus 1 according to the present embodiment can inhibit occurrence of a ghost image. Accordingly, it is possible to sufficiently inhibit occurrence of a ghost image even if the charging roller 51 is located in contact with or adjacent to the circumferential surface 50*a* of the photosensitive member 50.

A distance between the charging roller 51 and the circumferential surface 50*a* of the photosensitive member 50 is preferably no greater than 50 μm, and more preferably no greater than 30 μm. The image forming apparatus 1 according to the present embodiment can sufficiently inhibit occurrence of a ghost image even if the distance between the charging roller 51 and the circumferential surface 50*a* of the photosensitive member 50 is in the above-specified range.

Preferably, the charging voltage (charging bias) that is applied to the charging roller 51 is a direct current voltage. The amount of electrical discharge from the charging roller 51 to the photosensitive member 50 can be smaller and the abrasion amount of the photosensitive layer 502 of the photosensitive member 50 can be smaller in a configuration in which the charging voltage is a direct current voltage than in a configuration in which the charging voltage is a composite voltage obtained by superimposing an alternating current voltage on a direct current voltage.

A ghost image is likely to occur particularly when the charging roller 51 is located in contact with or adjacent to the circumferential surface 50*a* of the photosensitive member 50 and the charging voltage is a direct current voltage. However, as long as the photosensitive member 50 satisfies formula (1), the image forming apparatus 1 according to the present embodiment can inhibit occurrence of a ghost image even if the charging roller 51 is located in contact with or adjacent to the circumferential surface 50*a* of the photosensitive member 50 and the charging voltage is a direct current voltage.

The charging roller 51 has an electric resistance of preferably at least 4.0 log Ω and no greater than 7.0 log Ω, and more preferably at least 4.5 log Ω and no greater than 6.5 log Ω. As a result of the charging roller 51 having an electric resistance of at least 4.0 log Ω, production of pinholes can be inhabited. Specifically, in a case where a black image including a blank area (area not subjected to printing) is formed on a sheet P using the image forming apparatus 1, occurrence of black spots in the blank area can be inhibited. As a result of the charging roller 51 having an electric resistance of at least 4.5 log Ω, production of pinholes can be further inhabited. As a result of the charging roller 51 having an electric resistance of no greater than 7.0 log Ω, charge is further readily discharged from the surface 51*d* of the charging roller 51 to the photosensitive member 50. Therefore, adjustment of the surface potential of the photosensitive member 50 to a desired potential can be facilitated. In turn, in a case where a black image including a blank area (area not subjected to printing) is formed on a sheet P using the image forming apparatus 1, occurrence of fogging (black smear) in the blank area can be inhibited. As a result of the charging roller 51 having an electric resistance of no greater than 6.5 log Ω, charge is further readily discharged from the surface 51*d* of the charging roller 51 to the photosensitive member 50. The electric resistance of the charging roller 51 can be measured according to a method described in association with Examples.

The charging roller 51 has an outer diameter of at least 5 mm and no greater than 20 mm, for example. The base layer 51*b* of the charging roller 51 has a thickness of at least 1 mm and no greater than 5 mm, for example. The conductive shaft 51*a* of the charging roller 51 is made from metal, for example.

The surface layer 51*c* has a thickness of preferably at least 5 μm and no greater than 30 μm, and more preferably at least 10 μm and no greater than 20 μm. As a result of the surface layer 51*c* having a thickness of at least 5 μm, occurrence of insulation breakdown of the surface layer 51*c* can be inhibited. As a result of the surface layer 51*c* having a thickness of no greater than 30 μm, occurrence of irregularity in film thickness of the surface layer 51*c* can be inhibited.

The lower limit of the volume resistivity of the surface layer 51*c* is 13.0 log Ω·cm. The upper limit of the volume resistivity of the surface layer 51*c* is preferably 17.8 log Ω·cm, and more preferably 16.0 log Ω·cm. When the surface layer 51*c* has a volume resistivity of less than 13.0 log Ω·cm, formation of an image on a sheet P using the image forming apparatus 1 may cause occurrence of charge irregularity in the image formed on the sheet P. When the surface layer 51*c* has a volume resistivity of no greater than 17.8 log Ω·cm, charge is more readily discharged from the surface 51*d* of the charging roller 51 to the photosensitive member 50. When the surface layer 51*c* has a volume resistivity of no greater than 16.0 log Ω·cm, charge is more readily discharged from the surface 51*d* of the charging roller 51 to the photosensitive member 50. Therefore, adjustment of the surface potential of the photosensitive member 50 to a desired potential can be facilitated. In turn, in a case where a black image including a blank area (area not subjected to printing) is formed on a sheet P using the image forming apparatus 1, occurrence of fogging (black smear) in the blank area can be inhibited. The volume resistivity of the surface layer 51*c* can be measured according to a method described in association with Examples.

The base layer 51*b* contains for example rubber. Examples of the rubber contained in the base layer 51*b* include polyurethane-based elastomer, hydrin rubber (specifically, epichlorohydrin rubber), styrene-butadiene rubber (SBR), polynorbornene rubber, ethylene propylene diene monomer rubber (EPDM), acrylonitrile-butadiene rubber (NBR), hydrogenated acrylonitrile-butadiene rubber (H-NBR), butadiene rubber (BR), isoprene rubber (IR), natural rubber (NR), and silicone rubber. Any one of the rubbers listed above may be used independently, or any two or more of the rubbers listed above may be used in combination. A preferable rubber that the base layer 51*b* contains is epichlorohydrin rubber. The base layer 51*b* may further contain a conducting agent in order to increase conductivity. Examples of the conducting agent include carbon black, graphite, potassium titanate particles, iron oxide particles, titanium oxide particles, zinc oxide particles, tin oxide particles, and ion conducing agents (examples include quaternary ammonium salts, borates, and surfactants). Any one of the conducting agents listed above may be used independently, or any two or more of the conducting agents listed above may be used in combination. A preferable conducting agent is an ion conducting agent. The base layer 51*b* may further contain any of a foaming agent, a crosslinking agent, a crosslinking accelerator, and an oil as necessary.

It is favorable that the surface layer 51*c* contains a second binder resin. Examples of the second binder resin include polyamide resins, acrylic fluorine-based resins, and acrylic silicone-based resins. Examples of the polyamide resins include N-methoxymethylated nylon resins, ethoxymethylated nylon resins, and copolymerized nylon resins. One of the second binder resins listed above may be used independently, or two or more of the second binder resins listed above may be used in combination. A polyamide resin is preferable as the second binder resin.

The surface layer 51*c* may further contain a conductive filler as necessary. Examples of the conductive filler include carbon black, graphite, potassium titanate particles, iron oxide particles, titanium oxide particles, zinc oxide particles, phosphorus-doped tin oxide particles, and zinc oxide particles. The conductive filler is preferably tin oxide particles, phosphorous-doped tin oxide particles, or titanium oxide particles. The conductive filler preferably has an average particle diameter of at least 5 nm and no greater than 200 nm. The surface layer 51*c* may further contain any of a foaming agent, a crosslinking agent, a crosslinking accelerator, and an oil as necessary. The average particle diameter of the conductive filler is a value obtained according to the following method. First, equivalent circle diameters of primary particles of 20 particles of the conductive filler (Heywood diameter: diameters of circles having the same areas as projected areas of the particles) are measured using a microscope (for example, a transmission electron microscope). An arithmetic mean value of the equivalent circle diameters is taken to be an average particle diameter of the conductive filler.

In a case where the surface layer 51*c* contains a conductive filler, the amount of the conductive filler in the surface layer 51*c* may be adjusted as appropriate according to the material of the surface layer 51*c*. The amount of the conductive filler is a ratio of mass of the conductive filler to mass of the second binder resin. In a case where the surface layer 51*c* contains a nylon resin and tin oxide particles being a conductive filler, the amount of the conductive filler is preferably at least 10% by mass and no greater than 30% by mass. In a case where the surface layer 51*c* contains a nylon resin and phosphorus-doped tin oxide particles being a conductive filler, the amount of the conductive filler is preferably at least 10% by mass and no greater than 30% by mass. In a case where the surface layer 51*c* contains a nylon resin (having low hygroscopicity) and titanium oxide particles being a conductive filler, the amount of the conductive filler is preferably at least 30% by mass and no greater than 70% by mass. In a case where the surface layer 51*c* contains a nylon resin (having low hygroscopicity) and tin oxide particles being a conductive filler, the amount of the conductive filler is preferably at least 40% by mass and no greater than 60% by mass. The volume resistivity of the surface layer 51*c* can be adjusted within a desired range for example by adjusting the material of the conductive filler, the content percentage of the conductive filler, and the type of the second binder resin.

<Primary Transfer Roller>

Figure 9:
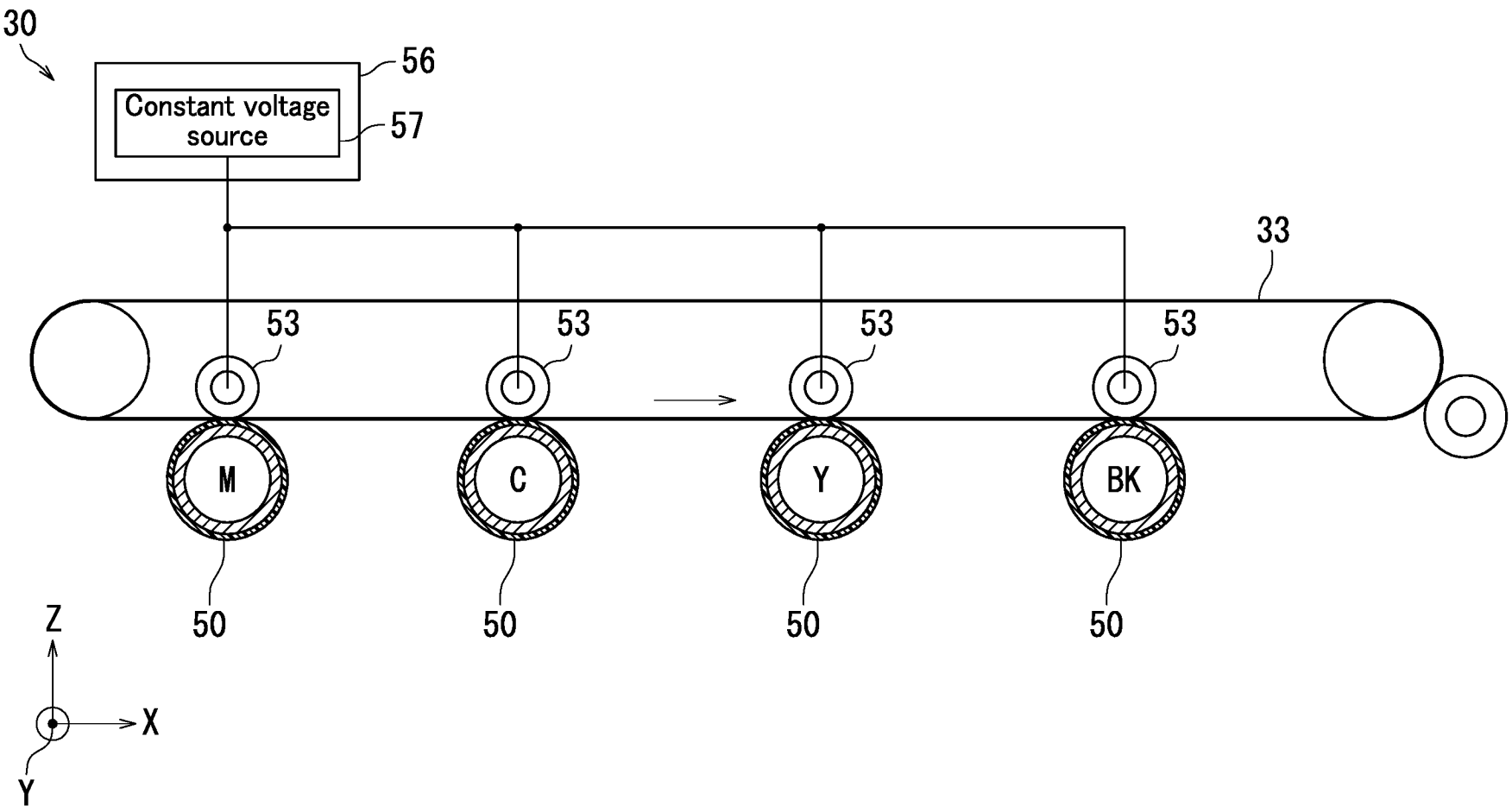
FIG. 9 is a diagram illustrating a power supply system for primary transfer rollers included in the image forming apparatus illustrated in FIG. 1.

The following describes the primary transfer rollers 53, which are under constant-voltage control, with reference to FIG. 9. FIG. 9 is a diagram illustrating a power supply system for the four primary transfer rollers 53. As illustrated in FIG. 9, the image forming section 30 further includes a power source 56 connected to the four primary transfer rollers 53. The power source 56 can charge each of the primary transfer rollers 53. The power source 56 includes a single constant voltage source 57 connected to the four primary transfer rollers 53. The constant voltage source 57 applies a transfer voltage (transfer bias) to the primary transfer rollers 53 in primary transfer to charge each of the primary transfer rollers 53. The constant voltage source 57 generates a constant transfer voltage (for example, a constant negative transfer voltage). That is, the primary transfer rollers 53 are under constant-voltage control. A toner image carried on the circumferential surface 50*a* of each photosensitive member 50 is primarily transferred to the outer circumferential surface of the rotating transfer belt 33 due to presence of a potential difference (transfer field) between a surface potential of the circumferential surface 50*a* of each photosensitive member 50 and a surface potential of a corresponding one of the primary transfer rollers 53.

Electric current (for example, negative electric current) flows into the photosensitive members 50 from the respective primary transfer rollers 53 through the transfer belt 33 in primary transfer. In a configuration in which the primary transfer rollers 53 are disposed directly above the respective photosensitive members 50, electric current flowing into the photosensitive members 50 flows in a thickness direction of the transfer belt 33 from the respective primary transfer rollers 53. The electric current flowing into the photosensitive members 50 (flow-in current) changes as the volume resistivity of the transfer belt 33 changes provided that a constant transfer voltage is applied to the primary transfer rollers 53. The tendency of a ghost image to occur increases with an increase in the flow-in current. That is, a ghost image is more likely to occur in an image formed by the image forming apparatus 1 including the primary transfer rollers 53, which are under constant-voltage control, than in an image formed by an image forming apparatus that adopts constant-current control. However, as a result of the image forming apparatus 1 including the photosensitive members 50 that can inhibit occurrence of a ghost image, occurrence of a ghost image can be inhibited even if an image is formed using the image forming apparatus 1 including the primary transfer rollers 53 under constant-voltage control. Furthermore, in the image forming apparatus 1 including the primary transfer rollers 53 under constant-voltage control, the number of constant voltage sources 57 can be smaller than the number of primary transfer rollers 53. Thus, the image forming apparatus 1 can be simplified and miniaturized.

In order to stably perform primary transfer of the toners T from the primary transfer rollers 53 to the transfer belt 33, electric current (transfer current) flowing in the primary transfer rollers 53 in transfer voltage application is preferably at least −20 μA and no greater than −10 μA.

<Static Elimination Lamp>

Each of the static elimination lamps 54 is located downstream of a corresponding one of the primary transfer rollers 53 in the rotational direction R of a corresponding one of the photosensitive members 50. Each of the cleaners 55 is located downstream of a corresponding one of the static elimination lamps 54 in the rotational direction R of a corresponding one of the photosensitive members 50. Each of the charging rollers 51 is located downstream of a corresponding one of the cleaners 55 in the rotational direction R of a corresponding one of the photosensitive members 50. As a result of the respective static elimination lamps 54 being located between the primary transfer rollers 53 and the cleaners 55, time between static elimination on the circumferential surfaces 50*a* of the photosensitive members 50 by the static elimination lamps 54 and completion of charging of the circumferential surfaces 50*a* of the photosensitive members 50 by the charging rollers 51 (also referred to below as static elimination-charging time) can be elongated. Thus, time in which excitation carrier generated within the photosensitive layers 502 is extinguished can be secured. The static elimination-charging time is preferably 20 ms or longer, and more preferably 50 ms or longer.

A static elimination light intensity of each static elimination lamp 54 is preferably at least 0 μJ/cm$^2$ and no greater than 10 μJ/cm$^2$, and more preferably at least 0 μJ/cm$^2$ and no greater than 5 μJ/cm$^2$. As a result of the static elimination light intensity of each static elimination lamp 54 being no greater than 10 μJ/cm$^2$, an amount of charge trapped within the photosensitive layers 502 of the photosensitive members 50 decreases, so that chargeability of the photosensitive members 50 can be increased. A smaller static elimination light intensity of each static elimination lamp 54 is more preferable. The static elimination lamps 54 having a static elimination light intensity of 0 μJ/cm$^2$ means that static electricity on the photosensitive members 50 is not eliminated by the static elimination lamps 54. That is, the static elimination lamps 54 do not perform static elimination. The static elimination light intensity of each static elimination lamp 54 can be measured according to a method described in association with Examples.

<Cleaner>

Each of the cleaners 55 includes a cleaning blade 81 and a toner seal 82. Each of the cleaning blades 81 is located downstream of a corresponding one of the primary transfer rollers 53 in the rotational direction R of a corresponding one of the photosensitive members 50. The cleaning blade 81 is pressed against the circumferential surface 50*a* of the photosensitive member 50 and collects residual toner T on the circumferential surface 50*a* of the photosensitive member 50. The residual toner T is toner T remaining on the circumferential surface 50*a* of the photosensitive member 50 after primary transfer. Specifically, an edge of the cleaning blade 81 is pressed against the circumferential surface 50*a* of the photosensitive member 50, and a direction from a base end toward the edge of the cleaning blade 81 is opposite to the rotational direction R at a contact point between the edge of the cleaning blade 81 and the circumferential surface 50*a* of the photosensitive member 50. The cleaning blade 81 is in generally-called counter-contact with the circumferential surface 50*a* of the photosensitive member 50. In the above configuration, the cleaning blade 81 is tightly pressed against the circumferential surface 50*a* of the photosensitive member 50 such that the cleaning blade 81 digs into the photosensitive member 50 as the photosensitive member 50 rotates. Insufficient cleaning can be further prevented through the cleaning blade 81 being tightly pressed against the circumferential surface 50*a* of the photosensitive member 50. The cleaning blade 81 is for example a plate-shaped elastic body, more specifically, is a rubber plate. The cleaning blade 81 is in line-contact with the circumferential surface 50*a* of the photosensitive member 50.

Preferably, a linear pressure of the cleaning blade 81 on the circumferential surface 50*a* of the photosensitive member 50 is at least 10 N/m and no greater than 40 N/m. As a result of the linear pressure of the cleaning blade 81 on the circumferential surface 50*a* of the photosensitive member 50 being at least 10 N/m, insufficient cleaning can be prevented. As a result of the linear pressure of the cleaning blade 81 on the circumferential surface 50*a* of the photosensitive member 50 being no greater than 40 N/m, occurrence of a ghost image can be further inhibited. In order to further inhibit occurrence of a ghost image and further prevent insufficient cleaning, the linear pressure of the cleaning blade 81 on the circumferential surface 50*a* of the photosensitive member 50 is preferably at least 15 N/m and no greater than 40 N/m, more preferably at least 20 N/m and no greater than 40 N/m, further preferably at least 25 N/m and no greater than 40 N/m, further more preferably at least 30 N/m and no greater than 40 N/m, and particularly preferably at least 35 N/m and no greater than 40 N/m. The linear pressure of the cleaning blade 81 on the circumferential surface 50*a* of the photosensitive member 50 may be within a range of two values selected from 10 N/m, 15 N/m, 20 N/m, 25 N/m, 30 N/m, 35 N/m, and 40 N/m.

The cleaning blade 81 has a hardness of preferably at least 60 degrees and no greater than 80 degrees, and more preferably at least 70 degrees and no greater than 78 degrees. As a result of the cleaning blade 81 having a hardness of at least 60 degrees, insufficient cleaning can be favorably prevented because the cleaning blade 81 is not excessively soft. As a result of the cleaning blade 81 having a hardness of no greater than 80 degrees, an abrasion amount of the photosensitive layer 502 of the photosensitive member 50 can be reduced because the cleaning blade 81 is not excessively hard. The hardness of the cleaning blade 81 can be measured according to a method described in association with Examples.

The cleaning blade 81 has a rebound rate of preferably at least 20% and no greater than 40%, and more preferably at least 25% and no greater than 35%. The rebound rate of the cleaning blade 81 can be measured according to a method described in association with Examples.

The toner seal 82 is in contact with the circumferential surface 50*a* of the photosensitive member 50 at a location between the primary transfer roller 53 and the cleaning blade 81, and inhibits scattering of toner T collected by the cleaning blade 81.

<Thrust Mechanism>

Figure 10:
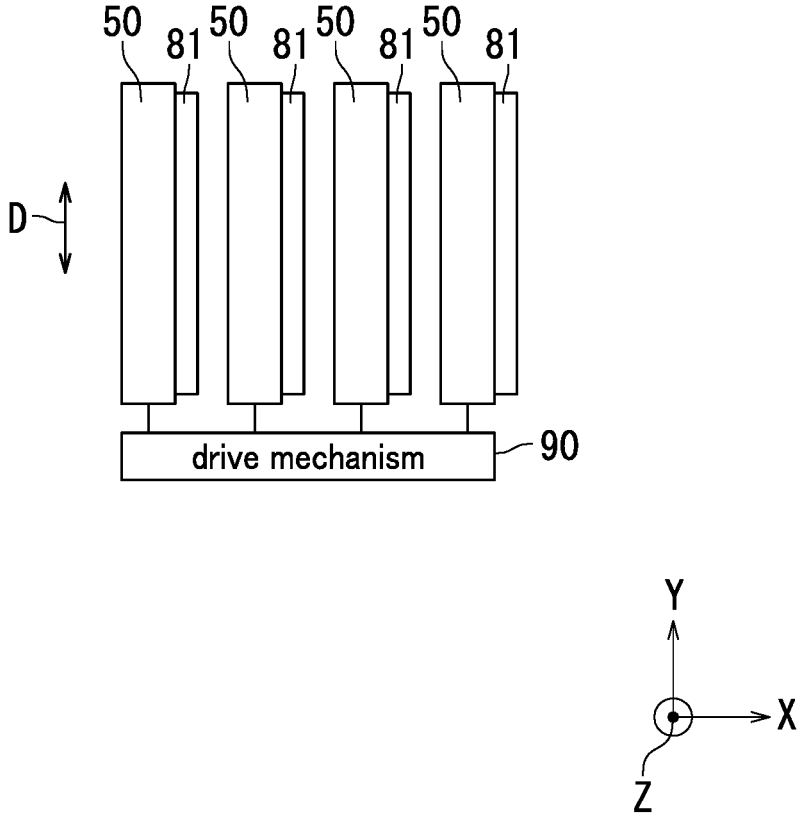
FIG. 10 is a diagram illustrating a drive mechanism for implementing a thrust mechanism.

The following describes a drive mechanism 90 for implementing a thrust mechanism with reference to FIG. 10. FIG. 10 is a plan view describing the photosensitive members 50, the cleaning blades 81, and the drive mechanism 90. Each of the photosensitive members 50 has a cylindrical shape extending in the rotational axis direction D of the photosensitive member 50. Each of the cleaning blades 81 has a plate shape extending in parallel to the rotational axis direction D.

The image forming apparatus 1 further includes the drive mechanism 90. The drive mechanism 90 moves either one of the photosensitive member 50 and the cleaning blade 81 in parallel to the rotational axis direction D in a reciprocal manner. In the present embodiment, the drive mechanism 90 reciprocally moves each photosensitive member 50 in the rotational axis direction D. The drive mechanism 90 includes a gear train, cams, elastic members, and a power supply such as a motor. The cleaning blades 81 are secured to a housing of the image forming apparatus 1.

As described with reference to FIG. 10, the photosensitive members 50 are reciprocally moved in the rotational axis direction D relative to the respective cleaning blades 81 in the present embodiment. In the above configuration, local accumulation on and around the edge of each cleaning blade 81 can be moved in the rotational axis direction D, preventing a scratch in a circumferential direction of the corresponding photosensitive member 50 (referred to below as "a circumferential scratch") from occurring on the circumferential surface 50*a* thereof. As a result, a streak that may occur in output images due to the toner T stuck in such a circumferential scratch is prevented. Thus, good quality of output images can be maintained over a long period of time.

Furthermore, the photosensitive members 50 are moved reciprocally in the present embodiment. Accordingly, drive power for reciprocal movement can be easily obtained as compared to a configuration in which the cleaning blades 81 are moved reciprocally, and toner leakage from opposite ends of the cleaning blades 81 can be inhibited.

A thrust amount of the photosensitive members 50 refers to a distance by which the photosensitive member 50 travels in one way of one back-and-forth motion. Note that an outward thrust amount and a return thrust amount are equal to each other in the present embodiment. The thrust amount of the photosensitive members 50 is preferably at least 0.1 mm and no greater than 2.0 mm, and more preferably at least 0.5 mm and no greater than 1.0 mm. As a result of the thrust amount of the photosensitive members 50 being within the above-specified range, a circumferential scratch on the photosensitive members 50 can be favorably prevented.

A thrust period of the photosensitive members 50 refers to a time taken by each photosensitive member 50 to make one back-and-forth motion. In the present specification, the thrust period of the photosensitive members 50 is expressed in terms of the number of rotations of each photosensitive member 50 per back-and-forth motion of the photosensitive member 50. The rotation speed of the photosensitive members 50 is constant. Accordingly, a longer thrust period of the photosensitive members 50 (i.e., more rotations of each photosensitive member 50 per back-and-forth motion of the photosensitive member 50) means that the photosensitive members 50 reciprocate more slowly. By contrast, a shorter thrust period of the photosensitive members 50 (i.e., fewer rotations of each photosensitive member 50 per back-and-forth motion of the photosensitive member 50) means that the photosensitive members 50 reciprocate faster.

The thrust period of the photosensitive members 50 is preferably at least 10 rotations and no greater than 200 rotations, and more preferably at least 50 rotations and no greater than 100 rotations. As a result of the thrust period of the photosensitive members 50 being at least 10 rotations, it is easy to clean the circumferential surfaces 50*a* of the photosensitive members 50. Furthermore, as a result of the thrust period of the photosensitive members 50 being at least 10 rotations, the color image forming apparatus 1 tends not to undergo unintended coloristic shift. As a result of the thrust period of the photosensitive members 50 being no greater than 200 rotations by contrast, circumferential scratches on the photosensitive members 50 can be prevented.

Through the above, an example of the image forming apparatus 1 according to the present embodiment has been described. However, as long as the image forming apparatus 1 according to the present embodiment includes an image bearing member and a charging roller, other members (for example, a static elimination device and a cleaning device) may be dispensed with. Although a configuration in which the charging voltage is a direct current voltage has been described, the present disclosure is also applicable to a configuration in which the charging voltage is an alternating current voltage or a composite voltage. The composite voltage refers to a voltage obtained by superimposing an alternating current voltage on a direct current voltage. Although the development rollers 52 each using a two-component developer containing the carrier CA and the toner T have been described, the present disclosure is also applicable to development devices each using a one-component developer. Although the image forming apparatus 1 adopting an intermediate transfer process has been described, the present disclosure is also applicable to an image forming apparatus adopting a direct transfer process.

[Image Forming Method]

An image forming method according to a second embodiment of the present disclosure includes charging a circumferential surface of an image bearing member to a positive polarity using a charging roller. The image bearing member includes a conductive substrate and a photosensitive layer of a single layer, and satisfies formula (1) shown below. The photosensitive layer contains a charge generating material, a hole transport material, an electron transport material, and a binder resin. The charging roller includes a conductive shaft, a base layer covering a surface of the conductive shaft, and a surface layer covering a surface of the base layer. The surface layer has a volume resistivity at a temperature of 32.5° C. and a relative humidity of 80% of at least 13.0 log Ω–cm.

$$0.60 \leqq \frac{V}{(Q/S)\times(d/\varepsilon_r\cdot\varepsilon_0)} \quad (1)$$

In formula (1), Q represents a charge amount [C] of the circumferential surface of the image bearing member. S represents a charge area [$m^2$] of the charged circumferential surface of the image bearing member. d represents a film thickness [m] of the photosensitive layer. $\varepsilon_r$ represents a specific permittivity of the binder resin contained in the photosensitive layer. $\varepsilon_0$ represents vacuum permittivity [F/m]. V is a value [V] calculated in accordance with formula (2) $V=V_0-V_r$. $V_r$ represents a first potential [V] of the circumferential surface of the image bearing member yet to be charged by the charging roller in the charging. $V_0$ represents a second potential [V] of the circumferential surface of the image bearing member charged by the charging roller in the charging. The image forming method according to the present embodiment can be implemented for example by the image forming apparatus according to the first embodiment. According to the image forming method in the present embodiment, occurrence of a ghost image and charge irregularity can be inhibited.

Examples

The following further describes the present disclosure using examples. Note that the present disclosure is not limited to the scope of Examples.

<Measuring Method>

The following first describes methods for measuring physical properties exhibited in tests of Reference Examples, Examples, and Comparative Examples.

(Static Elimination Light Intensity)

An optical power meter ("OPTICAL POWER METER 3664", product of HIOKI E.E. CORPORATION) was embedded in a circumferential surface of a target photosensitive member at a position opposite to a static elimination lamp. Static elimination light having a wavelength of 660 nm was irradiated onto the photosensitive member using the static elimination lamp, and the intensity of the static elimination light at the circumferential surface of the photosensitive member was measured using the optical power meter.

(Linear Pressure of Cleaning Blade)

A linear pressure of a cleaning blade was measured using a load cell. Specifically, a jig was fabricated that was an evaluation apparatus of which a photosensitive member has been replaced with the load cell such that the load cell was disposed in a position of contact between a cleaning blade and the circumferential surface of the photosensitive member. The angle of contact between the cleaning blade and the load cell was set to 23 degrees. The cleaning blade was pressed against the load cell. The linear pressure of the cleaning blade was measured using the load cell after ten seconds from a start of the pressing. The thus measured linear pressure was taken to be the linear pressure of the cleaning blade.

(Hardness of Cleaning Blade)

The hardness of the cleaning blade was measured using a rubber hardness tester ("ASKER RUBBER HARDNESS TESTER Type JA", product of KOBUNSHI KEIKI CO., LTD.) by a method in accordance with Japanese Industrial Standards (JIS) K 6301.

(Rebound Rate of Cleaning Blade)

The rebound rate of the cleaning blade was measured using a rebound resilience tester ("RT-90", product of KOBUNSHI KEIKI CO., LTD) in accordance with Japanese Industrial Standards (JIS) K 6255 (corresponding to ISO 4662). The rebound rate was measured under environmental conditions of a temperature of 25° C. and a relative humidity of 50%.

<Evaluation Apparatus>

The following describes an evaluation apparatus used for testing Reference Examples, Examples, and Comparative Examples described below. The evaluation apparatus was a modified version of a multifunction peripheral ("TASKalfa (registered Japanese trademark) 356Ci, product of KYOCERA Document Solutions Inc.). A configuration and settings of the evaluation apparatus were as follows.

- Photosensitive member: positively chargeable single-layer OPC drum
- Diameter of photosensitive member: 30 mm
- Film thickness of photosensitive layer of photosensitive member: 30 μm
- Linear velocity of photosensitive member: 250 mm/second
- Thrust amount of photosensitive member: 0.8 mm
- Thrust period of photosensitive member: 70 rotations per back-and-forth motion
- Charger: charging roller
- Charging voltage: positive direct current voltage
- Material of charging roller: epichlorohydrin rubber with an ion conductor dispersed therein
- Diameter of charging roller: 12 mm
- Thickness of rubber-containing layer of charging roller: 3 mm
- Resistance of charging roller: 5.8 log Ω where a charging voltage of +500 V is applied thereto
- Distance between charging roller and circumferential surface of photosensitive member: 0 μm (direct discharge process)
- Effective charge length: 226 mm
- Transfer process: intermediate transfer process
- Transfer voltage: negative direct current voltage
- Material of transfer belt: polyimide
- Transfer width: 232 mm
- Static elimination light intensity: 5 $\mu J/cm^2$
- Static elimination-charging time: 125 milliseconds
- Cleaner: counter-contact cleaning blade
- Angle of contact of cleaning blade: 23 degrees
- Material of cleaning blade: polyurethane rubber
- Hardness of cleaning blade: 73 degrees
- Rebound rate of cleaning blade: 30%
- Thickness of cleaning blade: 1.8 mm
- Pressing method of cleaning blade: by fixing digging amount of cleaning blade in photosensitive member (fixed deflection)
- Amount of cleaning blade digging into photosensitive member: in a range of at least 0.8 mm and no greater than 1.5 mm (value varying according to linear pressure of cleaning blade)

<Production of Photosensitive Members>

Subsequently, photosensitive members were produced. The photosensitive members were produced using materials of photosensitive layers of photosensitive members according to methods as described below.

A charge generating material, a hole transport material, electron transport materials, a first binder resin, and an additive described below were prepared as the materials of the photosensitive layers of the photosensitive members.

(Charge Generating Material)

The Y-form titanyl phthalocyanine represented by chemical formula (CGM-1) described in association with the first embodiment was prepared as the charge generating material. The Y-form titanyl phthalocyanine did not exhibit a peak in a range of 50° C. or higher and 270° C. or lower other than a peak resulting from vaporization of adsorbed water and exhibited a peak in a range of 270° C. or higher and 400° C.

or lower (specifically, one peak at 296° C.) in a differential scanning calorimetry spectrum thereof.

(Hole Transport Material)

The hole transport material (HTM-1) described in association with the first embodiment was prepared as the hole transport material.

(Electron Transport Material)

The electron transport materials (ETM-1) and (ETM-3) described in association with the first embodiment were prepared each as the electron transport material.

(First Binder Resin)

The polyarylate resin (R-1) described in association with the first embodiment was prepared as the first binder resin. The polyarylate resin (R-1) had a viscosity average molecular weight of 60,000.

(Additive)

The additive (40-1) described in association with the first embodiment was prepared as the additive.

(Production of Photosensitive Member (P-A1))

A vessel of a ball mill was charged with 1.0 part by mass of the Y-form titanyl phthalocyanine as the charge generating material, 20.0 parts by mass of the hole transport material (HTM-1), 12.0 parts by mass of the electron transport material (ETM-1), 12.0 parts by mass of the electron transport material (ETM-3), 55.0 parts by mass of the polyarylate resin (R-1) as the first binder resin, and tetrahydrofuran as a solvent. The vessel contents were mixed for 50 hours using the ball mill to disperse the materials (the charge generating material, the hole transport material, the electron transport material, and the first binder resin) in the solvent. Through the above, an application liquid for photosensitive layer formation was obtained. The application liquid for photosensitive layer formation was applied onto a drum-shaped aluminum support as a conductive substrate by dip coating to form a liquid film. The liquid film was hot-air dried at 100° C. for 40 minutes. Through the above processes, a photosensitive layer of a single layer (film thickness 30 μm) was formed on the conductive substrate. As a result, a photosensitive member (P-A1) was obtained.

(Production of Photosensitive Members (P-A2) and (P-B1))

Each of photosensitive members (P-A2) and (P-B1) was produced according to the same method as in the production of the photosensitive member (P-A1) in all aspects other than that the charge generating material in an amount specified in Table 4 was used, the hole transport material in an amount specified in Table 4 was used, the electron transport material(s) of type and in an amount(s) specified in Table 4 was/were used, and the first binder resin in an amount specified in Table 4 was used.

(Production of Photosensitive Members (P-A3) and (P-B2))

Each of photosensitive members (P-A3) and (P-B2) was produced according to the same method as in the production of the photosensitive member (P-A1) in all aspect other than that the first binder resin of type and in an amount specified in Table 4 and the additive of type and in an amount specified in Table 4 were used. Note that the additive (40-1) was added in order to adjust chargeability of the photosensitive members.

<Measurement of Chargeability Ratio>

Chargeability ratios of the respective photosensitive members (P-A1) to (P-A3), (P-B1), and (P-B2) were measured in accordance with the chargeability ratio measurement method described in association with the first embodiment. Table 4 shows measurement results of the chargeability ratio.

In Table 4, "wt %", "CGM", "HTM", "ETM", and "Resin" respectively represent "% by mass", "charge generating material", "hole transport material", "electron transport material", and "first binder resin". "ETM-1/ETM-3" and "12.0/12.0" indicate that both 12.0 parts by mass of the electron transport material (ETM-1) and 12.0 parts by mass of the electron transport material (ETM-3) were added each as the electron transport material. Also, "-" indicates that no corresponding material is added. Amounts of the materials are each expressed in terms of a content percentage [% by mass] thereof in a corresponding photosensitive layer. Mass of each photosensitive layer is equivalent to total mass of solids (more specifically, the charge generating material, the hole transport material, the electron transport material(s), the first binder resin, and the additive) contained in a corresponding one of application liquids for photosensitive layer formation.

TABLE 4

| | CGM | | HTM | | ETM | | Resin | | Additive | | |
|---|---|---|---|---|---|---|---|---|---|---|---|
| Photosensitive member | Type | Amount [wt %] | Type | Amount [wt %] | Type | Amount [wt %] | Type | Amount [wt %] | Type | Amount [wt %] | Chargeability ratio |
| P-B1 | CGM-1 | 1.7 | HTM-1 | 36.0 | ETM-1 | 23.0 | R-1 | 39.3 | — | — | 0.32 |
| P-B2 | CGM-1 | 1.0 | HTM-1 | 20.0 | ETM-1/ETM-3 | 12.0/12.0 | R-1 | 53.6 | 40-1 | 1.4 | 0.48 |
| P-A3 | CGM-1 | 1.0 | HTM-1 | 20.0 | ETM-1/ETM-3 | 12.0/12.0 | R-1 | 54.2 | 40-1 | 0.8 | 0.61 |
| P-A1 | CGM-1 | 1.0 | HTM-1 | 20.0 | ETM-1/ETM-3 | 12.0/12.0 | R-1 | 55.0 | — | — | 0.71 |
| P-A2 | CGM-1 | 0.5 | HTM-1 | 20.0 | ETM-1/ETM-3 | 12.0/12.0 | R-1 | 55.5 | — | — | 0.95 |

<Relationship between Chargeability Ratio of Photosensitive Member and Evaluation of Ghost Image>

The photosensitive member (P-B1) was mounted in the evaluation apparatus. The transfer current of a primary transfer roller of the evaluation apparatus was set to −20 μA. The linear pressure of a cleaning blade of the evaluation apparatus was set to 40 N/m. A charging roller of the evaluation apparatus was used to charge the circumferential surface of the photosensitive member to a potential of +500 V. The potential (+500 V) of the circumferential surface of the charged photosensitive member was taken to be a surface potential $V_A$ [+V]. Next, the primary transfer roller of the evaluation apparatus was used to apply a transfer voltage to the circumferential surface of the photosensitive member. The potential of the circumferential surface of the photosensitive member after the application of the transfer voltage was measured using a surface electrometer (not shown, "MODEL 344 ELECTROSTATIC VOLTMETER", product of TREK, INC.) and taken to be the surface potential $V_B$

[+V]. A surface potential drop $\Delta V_{B-A}$ [V] due to transfer was calculated from the thus measured surface potential $V_B$ in accordance with the following formula: "$\Delta V_{B-A}$=surface potential $V_B$−surface potential $V_A$=surface potential $V_B$−500". A surface potential drop $\Delta V_{B-A}$ due to transfer of each of the photosensitive members (P-A1), (P-A2), (P-A3), and (P-B2) was measured according to the same method as in the measurement of the surface potential drop $\Delta V_{B-A}$ due to transfer of the photosensitive member (P-B1).

Figure 11:
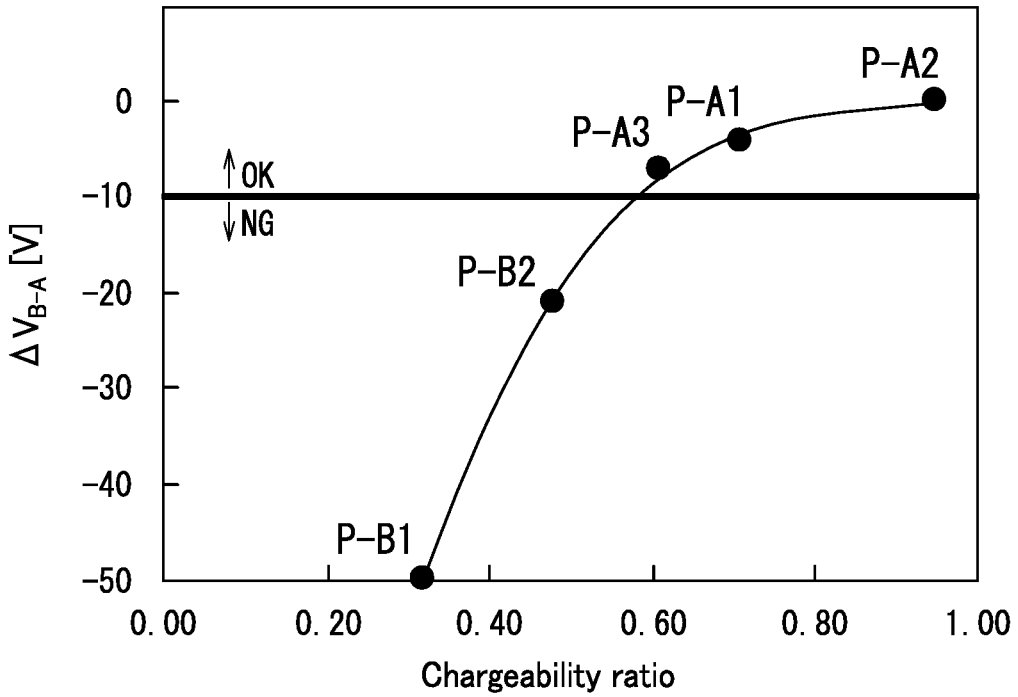
FIG. 11 is a graph representation illustrating a relationship between chargeability ratio and surface potential drop due to transfer for photosensitive members.

FIG. 11 shows measurement results of the surface potential drop $\Delta V_{B-A}$ due to transfer for the photosensitive members. A ghost image tends to occur in an output image when an absolute value of the surface potential drop $\Delta V_{B-A}$ due to transfer is 10 V or greater. The photosensitive members were evaluated as being capable of inhibiting occurrence of a ghost image (denoted by "OK") if the absolute value of the surface potential drop $\Delta V_{B-A}$ due to transfer was lower than 10 V in FIG. 11. The photosensitive members were evaluated as being incapable of inhibiting occurrence of a ghost image (denoted by "NG") if the absolute value of the surface potential drop $\Delta V_{B-A}$ due to transfer was 10 V or higher in FIG. 11.

As shown in FIG. 11, each of the photosensitive members (P-B1) and (P-B2) having a chargeability ratio of less than 0.60 had an absolute value of the surface potential drop $\Delta V_{B-A}$ due to transfer of 10 V or greater. It is therefore decided that the photosensitive members (P-B1) and (P-B2) are incapable of inhibiting occurrence of a ghost image when used to form images. As shown in FIG. 11, each of the photosensitive members (P-A1) to (P-A3) having a chargeability ratio of at least 0.60 had an absolute value of the surface potential drop $\Delta V_{B-A}$ due to transfer of less than 10 V. It is therefore decided that the photosensitive members (P-A1) to (P-A3) are capable of inhibiting occurrence of a ghost image when used to form images.

<Other Characteristics of Photosensitive Members>

With respect to each of the photosensitive members, surface friction coefficient, Martens hardness of the photosensitive layer, and sensitivity were measured.

(Surface Friction Coefficient of Circumferential Surface of Photosensitive Member)

Non-woven fabric ("KIMWIPES S-200", product of NIPPON PAPER CRECIA CO., LTD.) was placed on the circumferential surface of each photosensitive member, and a weight (load: 200 gf) was placed on the non-woven fabric. A contact area between the weight and the circumferential surface of the photosensitive member with the non-woven fabric therebetween was 1 $cm^2$. The photosensitive member was caused to laterally slide at a rate of 50 mm/second with the weight fixed. Lateral friction force in the lateral sliding was measured using a load cell. The surface friction coefficient of the circumferential surface of the photosensitive member was calculated in accordance with the following formula: "Surface friction coefficient=measured lateral friction force/200". The surface friction coefficients of the circumferential surfaces of the photosensitive members (P-A1) to (P-A3) were 0.45, 0.52, and 0.50, respectively. By contrast, the surface friction coefficients of the circumferential surfaces of the photosensitive members (P-B1) and (P-B2) were 0.55 and 0.53, respectively.

(Martens Hardness of Photosensitive Layer)

Martens hardness measurement was carried out according to nano-indentation in accordance with ISO14577 using a hardness tester ("FISCHERSCOPE (registered Japanese trademark) HM2000XYp", product of FISCHER INSTRUMENTS K.K.). The measurement was carried out as described below under environmental conditions of a temperature of 23° C. and a relative humidity of 50%. That is, a square pyramidal diamond indenter (opposite sides angled at 135 degrees) was brought into contact with the circumferential surface of the photosensitive layer, a load gradually increasing at a rate of 10 mN/5 seconds was applied to the indenter, the load was retained for one second once the load reached 10 mN, and the load was gradually removed over five seconds after the retention. The thus measured Martens hardness of the photosensitive layer of the photosensitive member (P-A1) was 220 $N/mm^2$.

(Sensitivity of Photosensitive Member)

With respect to each of the photosensitive members (P-A1) to (P-A3), sensitivity was evaluated. Evaluation of sensitivity was carried out under environmental conditions of a temperature of 23° C. and a relative humidity of 50%. First, the circumferential surface of the photosensitive member was charged to +500 V using a drum sensitivity test device (product of Gen-Tech, Inc.). Next, monochromatic light (wavelength: 780 nm, half-width: 20 nm, light intensity: 1.0 $\mu J/cm^2$) was obtained from white light of a halogen lamp using a bandpass filter. The thus obtained monochromatic light was irradiated onto the circumferential surface of the photosensitive member. A surface potential of the circumferential surface of the photosensitive member was measured when 50 milliseconds elapsed from termination of the irradiation. The thus measured surface potential was taken to be a post-irradiation potential [+V]. The measured post-irradiation potentials of the photosensitive members (P-A1), (P-A2), and (P-A3) were +110 V, +108 V, and +98 V, respectively.

These results demonstrate that the photosensitive members (P-A1) to (P-A3) each have a surface friction coefficient of the circumferential surface, a Martens hardness of the photosensitive layer, and sensitivity that are suitable for image formation.

<Production of Charging Rollers>

Next, charging rollers each including a surface layer in composition shown in Table 5 were produced. In Table 5, "wt %" represents an amount in terms of "% by mass" of a conductive filler relative to 100% by mass of the second binder resin.

TABLE 5

| | Surface layer | | | | Property |
|---|---|---|---|---|---|
| | Second | Conductive filler | | Volume resistivity and high humidity) | Electric resistance and high-humidity) |
| Charging roller | hinder resin Type | Type | Amount [w %] | (high-temperature logΩ · cm | (high-temperature logΩ |
| a-1 | Nylon resin | Carbon black | 4.8 | 7.24 | 5.12 |
| a-2 | Nylon resin | Tin oxide particles | 66.7 | 7.33 | 5.09 |
| a-3 | Nylon resin | Carbon black | 2.9 | 7.66 | 5.17 |

TABLE 5-continued

| | Surface layer | | | | Property |
|---|---|---|---|---|---|
| | Second | Conductive filler | | Volume resistivity and high humidity) | Electric resistance and high-humidity) |
| Charging roller | hinder resin Type | Type | Amount [w %] | (high-temperature logΩ · cm | (high-temperature logΩ |
| a-4 | Nylon resin | Tin oxide particles | 60.0 | 7.68 | 5.16 |
| a-5 | Nylon resin | Carbon black | 1.0 | 7.75 | 5.24 |
| a-6 | Nylon resin (low moisture adsorption) | Carbon black | 4.8 | 7.91 | 5.25 |
| a-7 | Nylon resin (low moisture adsorption) | Tin oxide particles | 66.7 | 8.15 | 5.16 |
| a-8 | Nylon resin | Phosphorous-doped tin oxide particles | 66.7 | 9.34 | 5.18 |
| a-9 | Nylon resin | Carbon black | 4.6 | 10.14 | 5.21 |
| a-10 | Nylon resin | Phosphorous-doped tin oxide particles | 60.0 | 10.17 | 5.22 |
| a-11 | Nylon resin | Tin oxide particles | 50.0 | 10.47 | 5.23 |
| a-12 | Nylon resin | Phosphorous-doped tin oxide particles | 50.0 | 11.38 | 5.28 |
| a-13 | Nylon resin | Carbon black | 0.5 | 12.09 | 5.18 |
| a-14 | Nylon resin | Phosphorous-doped tin oxide particles | 33.3 | 12.52 | 5.27 |
| a-15 | Nylon resin | Carbon black | 0.1 | 12.70 | 5.24 |
| a-16 | Nylon resin | Phosphorous-doped tin oxide particles | 9.1 | 12.80 | 5.26 |
| a-17 | Nylon resin | Tin oxide particles | 33.3 | 12.89 | 5.23 |
| a-18 | Nylon resin | — | 0.0 | 12.93 | 5.26 |
| A-1 | Nylon resin | Tin oxide particles | 20.0 | 13.42 | 5.30 |
| A-2 | Nylon resin | Phosphorous-doped tin oxide particles | 20.0 | 13.54 | 5.21 |
| A-3 | Nylon resin (low moisture adsorption) | Titanium oxide particles | 66.7 | 13.64 | 5.63 |
| A-4 | Nylon resin (low moisture adsorption) | Tin oxide particles | 50.0 | 13.80 | 5.52 |
| A-5 | Nylon resin (low moisture adsorption) | Titanium oxide particles | 60.0 | 14.49 | 5.94 |
| A-6 | Nylon resin (low moisture adsorption) | Titanium oxide particles | 50.0 | 14.93 | 6.29 |
| A-7 | Nylon resin (low moisture adsorption) | Titanium oxide particles | 33.3 | 16.24 | 6.60 |

Methods for producing the charging rollers and materials for forming surface layers used in production of the charging rollers are described below.

The following second binder resin and conductive fillers were prepared as materials for forming surface layers of charging rollers of Examples and Comparative Examples.

(Second Binder Resin)

Nylon resin solution: quaternary copolymer (nylon resin A) of nylon 6, nylon 12, nylon 66, and nylon 610, solid concentration: 80% by mass, water absorption: 10.2% by mass Nylon resin (low moisture adsorption) solution: resin (nylon resin B) obtained by changing the monomer ratio of the nylon resin A to decrease the content ratio of an aliphatic structure, solid concentration: 80% by mass, water absorption: 4.5% by mass, solvent: methanol and toluene Note that the water absorption of the nylon resin A is a value calculated in accordance with the following formula where W1 represents mass of the nylon resin A in a dried state and W2 represents mass of the dried nylon resin A after being immersed in water for 24 hours.

$$\text{Water absorption (\% by mass)}=((W2-W1)/W1)\times 100$$

The water absorption of the nylon resin B is a value calculated by the same method as in the calculation of the nylon resin A.

(Conductive Filler)

Carbon black: "KETJEN BLACK (registered Japanese trademark) EC300J", product of Lion Specialty Chemicals Co., Ltd.

Tin oxide particles: "S1", product of Mitsubishi Materials Corporation (BET specific surface area 50 to 60 $m^2/g$)

Tin oxide particles (doped with phosphorous): "SP2", product of Mitsubishi Materials Corporation (BET specific surface area 80 to 130 $m^2/g$)

Titanium oxide particles: "MT-05", product of TAYCA CORPORATION (primary particle diameter 0.01 μm)

(Production of Charging Roller (A-1))

The surface of a conductive shaft made from aluminum (diameter 9 mm) was covered with a base layer. The base layer contained an ion conducting agent and epichlorohydrin rubber. The base layer had a resistance of $2.3\times10^4\Omega$ and a thickness of 3 mm Through the covering, a member including the conductive shaft and the base layer covering the conductive shaft was obtained.

A vessel of a ball mill ("UNIVERSAL BALL MILL MODEL UB-32, product of Yamato Scientific Co., Ltd.) was charged with tin oxide particles being a conductive filler, a solvent (a mixed liquid of methanol, butanol, and toluene), and zirconia beads. The vessel contents were mixed at a rotational speed of 60 rpm for 24 hours using the ball mill. Subsequently, the vessel was further charged with a nylon resin solution as the second binder resin. The amount of the conductive filler was 20% by mass. The vessel contents were mixed at a rotational speed of 60 rpm for 24 hours using the ball mill. The vessel contents were filtered to remove the zirconia beads. Through the above processes, a surface layer coating liquid was obtained.

The surface layer coating liquid was applied onto the base layer of the member including the conductive shaft and the base layer covering the conductive shaft by dip coating to form a liquid film. The liquid film was hot-air dried at 120° C. for 40 minutes. Through the above processes, a surface layer (film thickness 10 μm) was formed on the base layer. Thus, the charging roller (A-1) was obtained.

(Production of Charging Rollers (A-2) to (A-7) and (a-1) to (a-18))

Charging rollers (A-2) to (A-7) and (a-1) to (a-18) were produced according to the same method as in the production of the charging roller (A-1) in all aspects other than changes in type of the second binder resin and changes in type and amount of the conductive filler. Types of the second binder resin and types and amounts of the conductive filler for the charging rollers are shown in Table 5.

(Electric Resistance of Charging Roller)

The electric resistance of each of the charging rollers (A-1) to (A-7) and (a-1) to (a-18) was measured according to the following method. Note that the electric resistance of each charging roller was measured in a high-temperature and high-humidity environment at a temperature of 32.5° C. and a relative humidity of 80%. A jig was used for measuring the electric resistance of each charging roller. The jig included a metal roller on which the charging roller is to be placed, a voltage applicator that applies a voltage to the charging roller, and an ammeter that measures a value of an electric current flowing in the charging roller.

First, the charging roller being a measurement target was left to stand for 4 hours in a high-temperature and high-humidity environment at a temperature of 32.5° C. and a relative humidity of 80%. After being left to stand, the charging roller was placed on the metal roller of the jig. A load of 500 gf is applied to each of the opposite ends of the charging roller. That is, a total load of 1 kgf was applied to the charging roller. Then, a charging voltage (charging bias) of +500 V was applied to the shaft of the charging roller using the voltage applicator of the jig with the load applied thereto. The current value of the charging roller was measured using the ammeter after 3 seconds from the application of the charging voltage. An electric resistance [Ω] of the charging roller being the measurement target was calculated from the applied charging voltage (+500V) and the measured current value. Measurement results are shown in Table 5.

(Volume Resistivity of Surface Layer)

The volume resistivity of the surface layer of each of the charging rollers (A-1) to (A-7) and (a-1) to (a-18) was measured according to the following method. Note that the volume resistivity of the surface layer was measured under high-temperature and high-humidity environmental conditions of a temperature of 32.5° C. and a relative humidity of 80%.

A surface layer coating liquid for surface layer formation was applied onto a cylindrical aluminum tube to form a liquid film. The liquid film was hot-air dried at 120° C. for 40 minutes. Through the above processes, a surface layer (film thickness 10 μm) was formed on the aluminum tube. The surface resistance of the surface layer was measured using a resistivity meter (HIRESTA-UX (registered Japanese trademark) MCP-HT800, product of Mitsubishi Chemical Analytech Co., Ltd.). Specifically, two metal electrodes were brought into contact with the surface layer with a 20-mm distance apart from each other and a direct current voltage of 10 V, 100 V, or 1,000 V was applied thereto. After 10 seconds elapsed from the application of the direct current voltage, the surface resistance of the surface layer was measured with the direct current voltage applied.

The volume resistivity of the surface layer was calculated from the film thickness of the surface layer and the measured value of the surface resistance of the surface layer in accordance with the following formula. Measurement results are shown in Table 5.

Volume resistivity (log Ω·cm)=surface resistance of surface layer (log Ω/□)×film thickness (cm)

Figure 12:
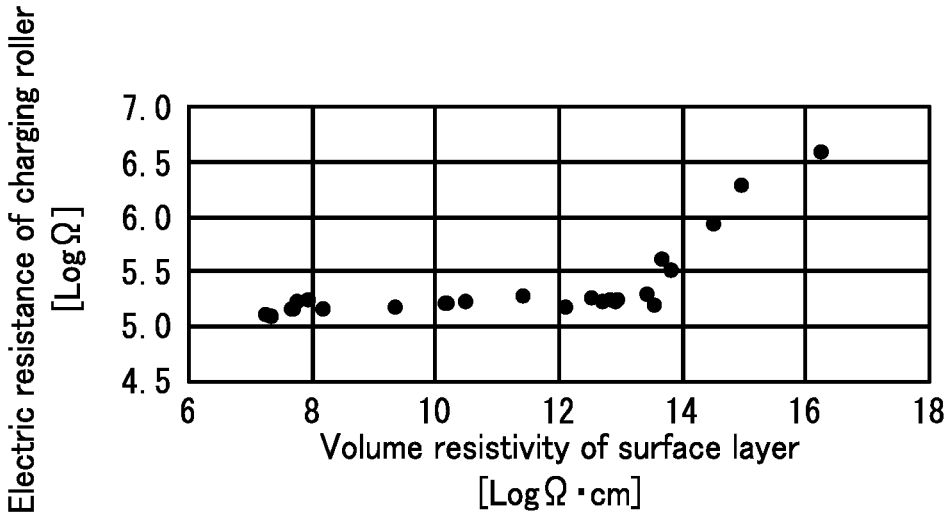
FIG. 12 is a graph representation showing a relationship between measurement results of volume resistivity of surface layers and measurement results of electric resistance of charging rollers for charging rollers of Examples.

The following describes relationships between surface layer volume resistivity and charging roller electric resistance for the charging rollers (A-1) to (A-7) and (a-1) to (a-18) with reference to FIG. 12. FIG. 12 shows a relationship between measurement results of surface layer volume resistivity and measurement results of charging roller electric resistance for the charging rollers (A-1) to (A-7) and (a-1) to (a-18).

As shown in FIG. 12, the electric resistance of a charging roller having a surface layer volume resistivity of less than 13.0 log Ω·cm was independent of the surface layer volume resistivity and was approximately 5.2 log Ω under the high-temperature and high-humidity environment. By contrast, it was found that the electric resistance of a charging roller having a surface layer volume resistivity of at least 13.0 log Ω·cm tends to increase as the surface layer volume resistivity increases. That is, when the surface layer volume resistivity is at least 13.0 log Ω·cm, the electric resistance of the charging roller depends on the surface resistance of the surface layer. Specifically, the electric resistance of each of the charging rollers (A-1) to (A-7) depends on the surface resistance of the surface layer of a corresponding charging roller.

<Production of Image Forming Apparatuses N1 to N25>

Image forming apparatuses N1 to N25 were produced according to the following method. First, the photosensitive member (PA-1) was mounted in the above-described evaluation apparatus. A charging roller of the evaluation apparatus was removed from the evaluation apparatus, and one of the charging rollers (A-1) to (A-7) and (a-1) to (a-18) was mounted therein. Thus, image forming apparatuses N1 to N25 that each were an evaluation apparatus for charging irregularity evaluation were prepared. Note that the image forming apparatuses N1 to N25 were set to have a transfer current of −20 μA, a linear pressure of a cleaning blade of 40 N/m, and a potential of a circumferential surface of the photosensitive member of +500 V.

[Image Evaluation]

Image evaluation for each of the image forming apparatuses N1 to N25 was carried out according to the following method.

<Evaluation of Charge Irregularity>

Each of the image forming apparatuses N1 to N25 was left to stand for 24 hours under environmental conditions of a temperature of 32.5° C. and a relative humidity of 80%. Then, a halftone image (printing rate 25%) was formed on each of three sheets P using the image forming apparatus under the same environmental conditions (first image formation test). After the first image formation test, the halftone image formed the last was visually observed to determine the presence or absence of charge irregularity (spots of voids). Charge irregularity was evaluated in accordance with the following criteria. Measurement results are shown in Table 6.

A (Good): No charge irregularity was observed.

B (Poor): Charge irregularity was observed.

<Evaluation of Chargeability>

After each of the image forming apparatuses N1 to N25 was left to stand for 24 hours under environmental conditions of a temperature of 32.5° C. and a relative humidity of 80%, a test image was formed on a sheet P using the image forming apparatus under the same environmental conditions (second image formation test). The test image included a blank area (non-printed area) and a black print area (area printed in black). After the second image formation test, the test image formed the last was visually observed to determine the presence or absence of fogging (black smear) in the blank area. Chargeability was evaluated in accordance with the following criteria. Measurement results are shown in Table 6.

A (Good): No fogging was observed.

B (Poor): Fogging was observed.

TABLE 6

| Image forming apparatus | Charging roller Type | Charging roller Surface layer Volume resistivity (high-temperature and high-humidity) logΩ · cm | Photosensitive member Type | Evaluation Charging irregularity | Evaluation Chargeability |
|---|---|---|---|---|---|
| N1 | a-1 | 7.24 | PA-1 | B | A |
| N2 | a-2 | 7.33 | PA-1 | B | A |
| N3 | a-3 | 7.66 | PA-1 | B | A |
| N4 | a-4 | 7.68 | PA-1 | B | A |
| N5 | a-5 | 7.75 | PA-1 | B | A |
| N6 | a-6 | 7.91 | PA-1 | B | A |
| N7 | a-7 | 8.15 | PA-1 | B | A |
| N8 | a-8 | 9.34 | PA-1 | B | A |
| N9 | a-9 | 10.14 | PA-1 | B | A |
| N10 | a-10 | 10.17 | PA-1 | B | A |
| N11 | a-11 | 10.47 | PA-1 | B | A |
| N12 | a-12 | 11.38 | PA-1 | B | A |
| N13 | a-13 | 12.09 | PA-1 | B | A |
| N14 | a-14 | 12.52 | PA-1 | B | A |
| N15 | a-15 | 12.70 | PA-1 | B | A |
| N16 | a-16 | 12.80 | PA-1 | B | A |
| N17 | a-17 | 12.89 | PA-1 | B | A |
| N18 | a-18 | 12.93 | PA-1 | B | A |
| N19 | A-1 | 13.42 | PA-1 | A | A |
| N20 | A-2 | 13.54 | PA-1 | A | A |
| N21 | A-3 | 13.64 | PA-1 | A | A |
| N22 | A-4 | 13.80 | PA-1 | A | A |
| N23 | A-5 | 14.49 | PA-1 | A | A |
| N24 | A-6 | 14.93 | PA-1 | A | A |
| N25 | A-7 | 16.24 | PA-1 | A | B |

Each of the image forming apparatuses N19 to N25 included an image bearing member and a charging roller that charges the circumferential surface of the image bearing member to a positive polarity. The image bearing member included a conductive substrate and a photosensitive layer of a single layer, and satisfied formula (1) shown above. The photosensitive layer contained a charge generating material, a hole transport material, an electron transport material, and a first binder resin. The charging roller included a conductive shaft, a base layer covering a surface of the conductive shaft, and a surface layer covering a surface of the base layer. The surface layer had a volume resistivity at a temperature of 32.5° C. and a relative humidity of 80% of at least 13.0 log Ω·cm. Each of the image forming apparatuses N19 to N25 accordingly inhibited occurrence of charge irregularity even under the high-temperature and high-humidity environmental conditions. Furthermore, the image forming apparatuses N19 to N25, each of which included the photosensitive member (PA-1), was decided to be capable of inhibiting occurrence of a ghost image.

By contrast, the image forming apparatuses N1 to N18 each did not have the above configuration. Specifically, each of the image forming apparatuses N1 to N18 included a surface layer of which volume resistivity was smaller than 13.0 log Ω·cm. Therefore, the image forming apparatuses N1 to N18 did not inhibit occurrence of charge irregularity.

Of the image forming apparatuses N19 to N25, the image forming apparatuses N19 to N24 each included a surface layer having a volume resistivity of no greater than 16.0 log Ω·cm. The image forming apparatuses N19 to N24 accordingly inhibited occurrence of fogging.

By contrast, the image forming apparatus N25 included a surface layer of which volume resistivity was greater than 16.0 log Ω·cm. The image forming apparatus N25 accordingly did not inhibit occurrence of fogging.

What is claimed is:

1. An image forming apparatus comprising:

an image bearing member; and a charging roller configured to charge a circumferential surface of the image bearing member to a positive polarity, wherein the image bearing member includes a conductive substrate and a photosensitive layer of a single layer, and satisfies formula (1) shown below, the photosensitive layer contains a charge generating material, a hole transport material, an electron transport material, and a first binder resin, the charging roller includes a conductive shaft, a base layer covering a surface of the conductive shaft, and a surface layer covering a surface of the base layer, and the surface layer has a volume resistivity at a temperature of 32.5° C. and a relative humidity of 80% of at least 13.0 log Ω·cm, $$0.60 \leqq \frac{V}{(Q/S)\times(d/\varepsilon_r\cdot\varepsilon_0)} \quad (1)$$

where in the formula (1),

Q represents a charge amount [C] of the circumferential surface of the image bearing member, S represents a charge area [$m^2$] of the charged circumferential surface of the image bearing member, d represents a film thickness [m] of the photosensitive layer, $\varepsilon_r$ represents a specific permittivity of the first binder resin contained in the photosensitive layer, $\varepsilon_0$ represents vacuum permittivity [F/m], V represents a value calculated in accordance with formula $V=V_0-V_r$, $V_r$ represents a first potential [V] of the circumferential surface of the image bearing member yet to be charged by the charging roller, and $V_0$ represents a second potential [V] of the circumferential surface of the image bearing member charged by the charging roller.

2. The image forming apparatus according to claim 1, wherein the volume resistivity of the surface layer at a temperature of 32.5° C. and a relative humidity of 80% is no greater than 17.8 log Ω·cm.

3. The image forming apparatus according to claim 2, wherein the volume resistivity of the surface layer at a temperature of 32.5° C. and a relative humidity of 80% is no greater than 16.0 log Ω·cm.

4. The image forming apparatus according to claim 1, wherein the charging roller has an electric resistance at a temperature of 32.5° C. and a relative humidity of 80% of at least 4.0 log Ω and no greater than 7.0 log Ω.

5. The image forming apparatus according to claim 4, wherein the electric resistance of the charging roller at a temperature of 32.5° C. and a relative humidity of 80% is at least 4.5 log Ω and no greater than 6.5 log Ω.

6. The image forming apparatus according to claim 1, wherein the surface layer has a film thickness of at least 10 μm and no greater than 20 μm.

7. The image forming apparatus according to claim 1, wherein the charging roller applies only a direct current voltage to the circumferential surface of the image bearing member.

8. The image forming apparatus according to claim 1, wherein the surface layer contains a conductive filler, and the conductive filler includes tin oxide particles, phosphorous-doped tin oxide particles, or titanium oxide particles.

9. The image forming apparatus according to claim 1, wherein the surface layer contains a second binder resin, and the second binder resin includes a polyamide resin.

10. An image forming method comprising charging a circumferential surface of an image bearing member to a positive polarity using a charging roller, wherein the image bearing member includes a conductive substrate and a photosensitive layer of a single layer, and satisfies formula (1) shown below, the photosensitive layer contains a charge generating material, a hole transport material, an electron transport material, and a binder resin, the charging roller includes a conductive shaft, a base layer covering a surface of the conductive shaft, and a surface layer covering a surface of the base layer, and the surface layer has a volume resistivity at a temperature of 32.5° C. and a relative humidity of 80% of at least 13.0 log Ω·cm, $$0.60 \leqq \frac{V}{(Q/S)\times(d/\varepsilon_r\cdot\varepsilon_0)} \quad (1)$$

where in the formula (1),

Q represents a charge amount [C] of the circumferential surface of the image bearing member, S represents a charge area [$m^2$] of the charged circumferential surface of the image bearing member, d represents a film thickness [m] of the photosensitive layer, $\varepsilon_r$ represents a specific permittivity of the binder resin contained in the photosensitive layer, $\varepsilon_0$ represents vacuum permittivity [F/m], V represents a value calculated in accordance with formula $V=V_0-V_r$, $V_r$ represents a first potential [V] of the circumferential surface of the image bearing member yet to be charged by the charging roller, and $V_0$ represents a second potential [V] of the circumferential surface of the image bearing member charged by the charging roller.

* * * * *